US007604205B2

(12) United States Patent
McCallum

(10) Patent No.: US 7,604,205 B2
(45) Date of Patent: Oct. 20, 2009

(54) TURNOUT/CROSSOVER SECTION FOR RAILWAY TRACK

(75) Inventor: Donald McCallum, Glasgow (GB)

(73) Assignee: Scott-Track Limited (GB)

( * ) Notice: Subject to any disclaimer, the term of this patent is extended or adjusted under 35 U.S.C. 154(b) by 428 days.

(21) Appl. No.: 10/524,727

(22) PCT Filed: Aug. 14, 2003

(86) PCT No.: PCT/GB03/03555

§ 371 (c)(1),
(2), (4) Date: Sep. 19, 2005

(87) PCT Pub. No.: WO2004/016853

PCT Pub. Date: Feb. 26, 2004

(65) Prior Publication Data

US 2006/0065791 A1 Mar. 30, 2006

(30) Foreign Application Priority Data

Aug. 16, 2002 (GB) ..... 0219066.8
May 17, 2003 (GB) ..... 0311403.0

(51) Int. Cl.
*E01B 7/00* (2006.01)

(52) U.S. Cl. ..... 246/374; 246/429

(58) Field of Classification Search ..... 246/383, 246/374, 432, 163, 376, 454, 465, 429; 238/12
See application file for complete search history.

(56) References Cited

U.S. PATENT DOCUMENTS

| | | | | | |
|---|---|---|---|---|---|
| 741,896 | A | * | 10/1903 | Eddy | 246/383 |
| 1,069,069 | A | * | 7/1913 | Kober | 238/12 |
| 1,315,702 | A | * | 9/1919 | Bridges | 238/12 |
| 1,340,992 | A | | 5/1920 | Toryowski | |
| 1,341,354 | A | | 5/1920 | Booth | |
| 1,405,556 | A | | 2/1922 | Odenkirk | |
| 1,480,739 | A | | 1/1924 | Bagby | |
| 1,493,093 | A | | 5/1924 | Ballou | |

FOREIGN PATENT DOCUMENTS

| | | |
|---|---|---|
| DE | 31 723 | 5/1885 |
| DE | 165316 | 11/1905 |
| DE | 11 67 371 | 4/1964 |
| DE | 26 49 830 | 9/1977 |
| GB | 197 789 | 5/1923 |
| GB | 405128 | 3/1932 |
| SE | 436 904 | 1/1985 |

* cited by examiner

*Primary Examiner*—Mark T Le
(74) *Attorney, Agent, or Firm*—Pepper Hamilton LLP

(57) ABSTRACT

A turnout for a railway track having a raised track surface to provide a path along which the wheels of a train can travel from one railway track to another. The raised track surface is of a sufficient height such that the wheels of the train are arranged to clear each railway track being crossed. The turnout facilitates Single Line Working on a second railway track to clear a first railway track for maintenance or other purposes. Pot sleepers for supporting rails of a railway track and a method of installing them is also provided.

8 Claims, 34 Drawing Sheets

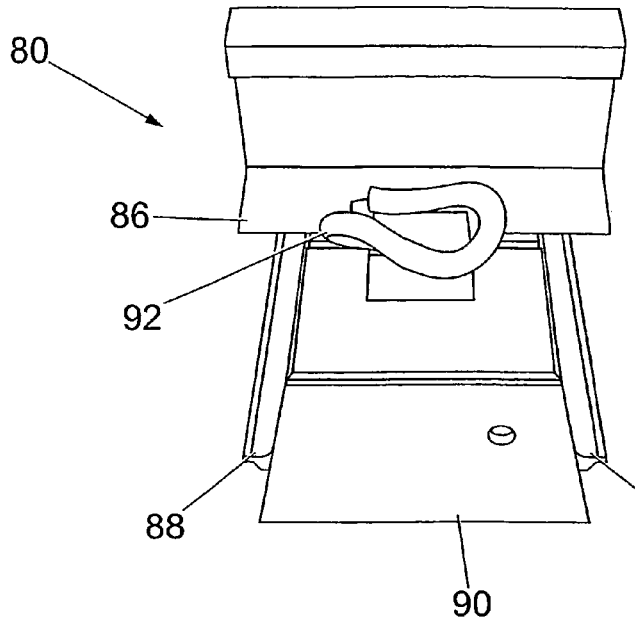
Fig. 34a
Fig. 34b
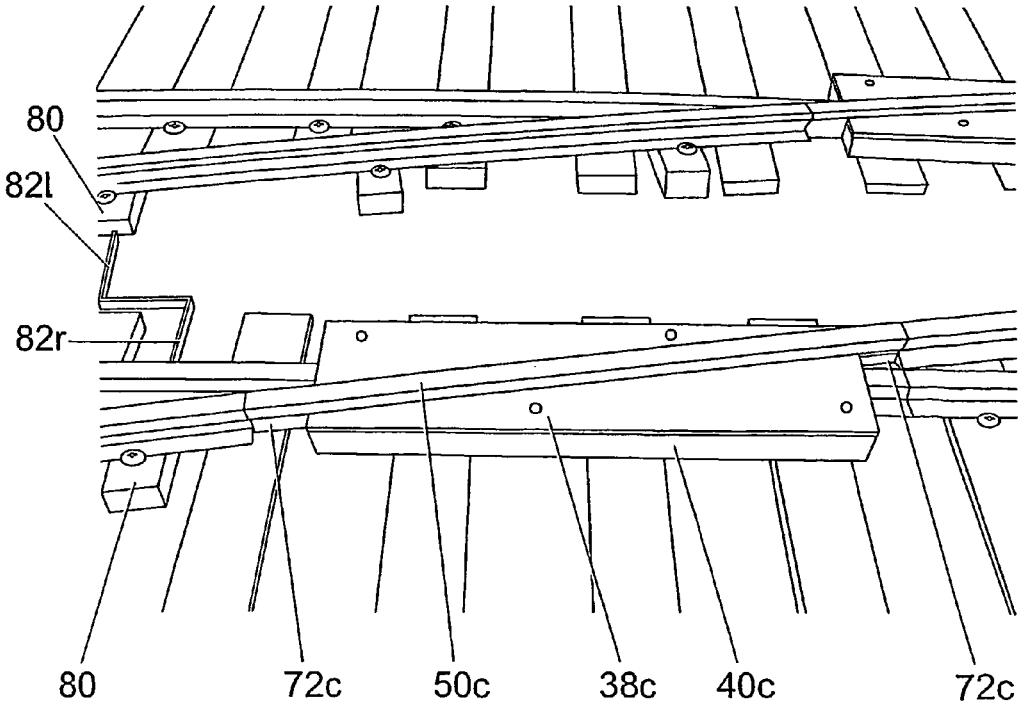

TURNOUT/CROSSOVER SECTION FOR RAILWAY TRACK

BACKGROUND OF THE TINVENTION 1. Field of the Invention

The present invention relates to a turnout or crossover section of railway track and particularly but not exclusively relates to providing a temporary non-intrusive turnout or crossover section of a railway track. 2. Description of Related Art Railway track requires to be maintained at regular intervals and in order to do this, the section of track that is being maintained must be cleared of trains. The track is normally closed to traffic often during no train periods and also outwith such periods thus causing train cancellations or trains being diverted to other routes for short or longer terms (blockades). In some instances, the trains are transferred from the track having the maintenance performed on it onto an adjacent track for a limited period (i.e. a few-hours) and then back onto the original track. The trains are transferred onto the adjacent track by means of a crossover section of track and returned by means of a second crossover. This is known in the art as "Single Line Working" (SLW). Conventionally, each of the crossover sections are intrusive, in that the section of track at which the crossover section is inserted must be cut; this involves cutting the existing rails of each railway track twice and installing the temporary crossover and also installing the switchgear along with providing an interface for signalling. However, such an intrusive crossover section is relatively expensive and requires a fairly long time to plan and to install, where the planning stage alone may take in the region of 2 years. The only other known alternative to solve this problem is to allow the trains to crossover at the nearest permanent crossover sections before and after the maintenance site but these may be many miles away and thus if repair or maintenance is required on only a few metres of track, trains may be forced to share one line of track for both directions (i.e. SLW) for many miles or may be extensively diverted onto alternative routes, thus leading to inefficiency and delays.

Those in the rail industry will also realise that there is a conflict between passengers who require train services during the daytime and freight trains which operate during the night and thus there is very little time to effect such repairs and maintenance. The overriding difficulty is access to the track for cost efficient maintenance.

It will be understood by those skilled in the art that a crossover comprises two individual turnouts, where a turnout can be used on its own or can be combined with another turnout to form a crossover.

In the context of this application, it should be noted that a non-intrusive crossover is one that does not pass through the rail to be crossed but instead crosses over the rail to be crossed.

SUMMARY OF THE INVENTION

According to a first aspect of the present invention there is provided a turnout for a railway track, the turnout comprising a raised track surface which is adapted to provide a path along which the wheels of a train can travel from one railway track to another, wherein the raised track surface is of a sufficient height such that the wheels of the train are arranged to clear the said railway tracks.

According to a first aspect of the present invention there is also provided a method of transferring a train from one railway track to a second railway track, the method comprising the steps of:

providing a raised track surface which is adapted to provide a path along which the wheels of the train can travel from the first to the second railway track;

driving the train along the first track and onto the raised track surface, wherein the raised track surface is of a sufficient height such that the wheels of the train are arranged to clear at least one (and preferably both) of the first and second railway tracks.

The invention has the advantage that it permits short length Single Line Working.

Preferably, a crossover comprises a pair of said turnouts.

According to a second aspect of the present invention, there is provided a system for facilitating Single Line Working on a second railway track to clear a first railway track for maintenance or other purposes, the system comprising a first and a second non-intrusive crossover being spaced apart from the first non-intrusive crossover in the direction of the longitudinal axis of the pair of railway tracks, in order to provide a path along which wheels of a train can travel from the first to the second railway track and from the second to the first railway track.

According to a second aspect of the present invention there is also provided a method which enables Single Line Working on a second railway track to clear a first railway track for maintenance by other purposes, the method comprising the steps of:

providing a first non-intrusive crossover;

providing a second non-intrusive crossover at a location which is spaced apart from the first non-intrusive crossover in the direction of the longitudinal axis of the pair of railway tracks;

passing the train along the first non-intrusive crossover;

passing the train along the portion of the second railway track between the first and second non-intrusive crossover;

passing the train along the second non-intrusive crossover, such that the train is now returned to a location on the first railway track which is spaced apart in the longitudinal direction from the first non-intrusive crossover.

Typically, the first and/or second non-intrusive crossover comprise a raised track surface, and preferably the raised track surface is provided with a supporting means to allow for passage of trains.

Typically, each of the first and second non-intrusive crossovers comprise a pair of turnouts, and preferably each pair of turnouts comprise a pair of rails.

Typically, each rail of the turnout further comprises a ramp surface, wherein, the ramp surface is preferably tapered from a short or no height end to a relatively tall height end. Most preferably, the ramp surface comprises a linear taper from the short or no height end to the relatively tall height end, and preferably the relatively tall height end is of the same height as that of the raised track surface. Typically, the relatively tall height end of the ramp surface is adjacent to an end of the raised track surface, the two combining to provide a path along which the wheel is permitted to travel whilst maintaining a substantially equal distance between a pair of raised rails, which combined, form the raised track surface. Preferably, the ramp surface comprises a ramp for each rail, where both ramps preferably incline simultaneously, typically avoiding differential levels, in relation to the respective rails.

In a first embodiment, at least a portion of each rail of the raised track surface may comprise a slot formed therein, typically below a rail head portion, wherein the slot may be arranged to lie over or around the rail being crossed and the rail head portion is releasably fixed to the said rail being crossed.

In a second, and preferred embodiment, at least a portion of each rail of the raised track surface, which typically forms part of a crossing rail, or a switch rail comprises a railhead portion arranged to lie over or around a supporting member which in turn is preferably arranged to lie over or around the rail being crossed. Preferably, the supporting member is arranged with its longitudinal axis being parallel to the rails of the parent rail. Preferably, the supporting member comprises at least an upper supporting member and at least a lower supporting member. Preferably, the upper supporting member is planar and more preferably, the upper surface of the upper supporting member is attached to at least a portion of the lower surface of the raised track.

Preferably, at least another portion of the raised track surface, which is typically the ramp surface, is supported by the parent rail and a fixing means.

Typically, the upper supporting planar member is substantially wider than an existing rail of one of the first and second railway tracks.

Preferably, the upper supporting planar member is rectangular in shape, and more preferably, is in the form of a plate.

Preferably, a pair of guide means are provided along at least a portion of the upper supporting member's length. Preferably the guide means run parallel to the upper supporting member's longitudinal axis, and more preferably, project downwardly in order, in use, to straddle an existing rail of the first and second existing railway tracks.

Preferably, a pair of lower supporting members are provided at either side of at least a portion of the existing rail.

Preferably, the pair of lower supporting members combine to provide a substantially similar shape, width and position along the existing railway track as the upper supporting member, and are adapted to be releasably engaged thereto and more preferably, releasably fixed thereto, wherein the lower surface of the upper supporting planar member preferably lies on top of the uppermost surface of the lower supporting members.

Alternatively, the lower supporting members combine to be longer and/or wider than the upper supporting member.

Preferably, normal running of a train along the first and/or second existing railway track(s) may be allowed, where the train does not travel between the first and second existing railway tracks by removing one or more sections of the crossover from engagement with the first and/or second existing railway tracks. Preferably, the one or more removable sections comprise at least a ramp, a first portion of the raised track surface, at least an upper supporting member, and leaving in place a second portion of the raised track surface, and at least a lower supporting member.

Typically, at least a portion of the raised track surface, which is preferably the same portion as before, is formed on top of a rail head portion or more particularly when referring to the crossing rail, a raised crossover member, wherein the height of the raised crossover member at least equals, and is preferably greater than, the depth of a flange portion of the wheel of the train.

Typically, the raised track surface comprises a plurality of rail members, one or more of which comprise a curved radius away from one of the railway tracks towards the other railway track.

Preferably, the plurality of rail members combine to form a turnout having a substantially continuous rail surface and includes the following components:

- a ramp member adapted to raise the train wheel to the raised height;
- a curved radius rail adapted to urge the train away from one of the railway tracks towards the other railway track;
- a substantially straight rail adapted to transfer the train from the curved radius rail of one track toward the other track; and
- a crossover rail adapted to allow the train to pass over the inner rails of the first and second existing railway tracks at the raised height.

Typically, at least a portion of the raised track surface, such as the substantially straight rail, is supported in the lateral and or vertical direction at a plurality of locations along its length by a support device. Preferably, the support device comprises a plurality of pot sleeper arrangements.

Preferably, the one or more turnouts are temporary turnouts and more preferably are non-intrusive turnouts.

According to a third aspect of the present invention, there is provided a pot sleeper for supporting a rail of a railway track, the pot sleeper comprising:

- a body having an, in use, substantially planar upper surface onto which rails may be connected;
- front and rear faces which extend downwardly at an angle to the upper surface, the faces having lower contact edges for contact with the ground; and
- a pair of side ends which extend downwardly at an angle to the upper surface for a greater distance than the front and rear faces.

The invention of the third aspect has the advantage that the pair of side ends project, in use, into the ground thereby providing resistance against lateral (side to side) movement of the pot sleeper, whilst the main weight of the pot sleeper, rail and train is borne by the contact edges and/or the underside of the substantially planar upper surface.

Preferably, said lower contact edges having a greater surface area than the cross-sectional area of the front and rear sides.

Preferably, the front and rear faces combine with the upper surface to form an inverted 'U' shaped body, whilst the pair of side ends combine to close the longitudinal axis of the 'U' shaped body. Preferably, the body is hollow, where the hollow body may be partially or wholly filled with a filling material and more preferably, the contact edges are formed by lips which project either inwardly or outwardly from the body (preferably outwardly) to provide a greater surface area to the body on the, in use, horizontal plane.

Typically, the upper surface is provided with a coupling mechanism to permit coupling of the pot sleeper to a rail. Preferably, a connection mechanism is provided to couple a first to a second respective pot sleeper, where the connection mechanism may include a substantially rigid member which extends therebetween. Typically, the substantially rigid member may be arranged to pass underneath the rails of the existing railway track.

Preferably, the pot sleepers are driven into ground ballast by a mechanical means which may be a vibrating mechanism means. Typically, further ballast or other material may be inserted into the hollow body to maintain/increase the height of the pot sleeper, in use.

BRIEF DESCRIPTION OF THE DRAWINGS

Embodiments of the present invention will now be described, by way of example only, with reference to the accompanying drawings, in which:

FIG. 34*a* is side view of the pot sleeper arrangement of FIG. 24*c* with a sample rail section fixed thereto;

FIG. 34*b* is a perspective view showing the pot sleeper arrangement and switch rail of FIG. 24*c* in their operational positions;

DETAILED DESCRIPTION OF THE INVENTION

Figure 1:
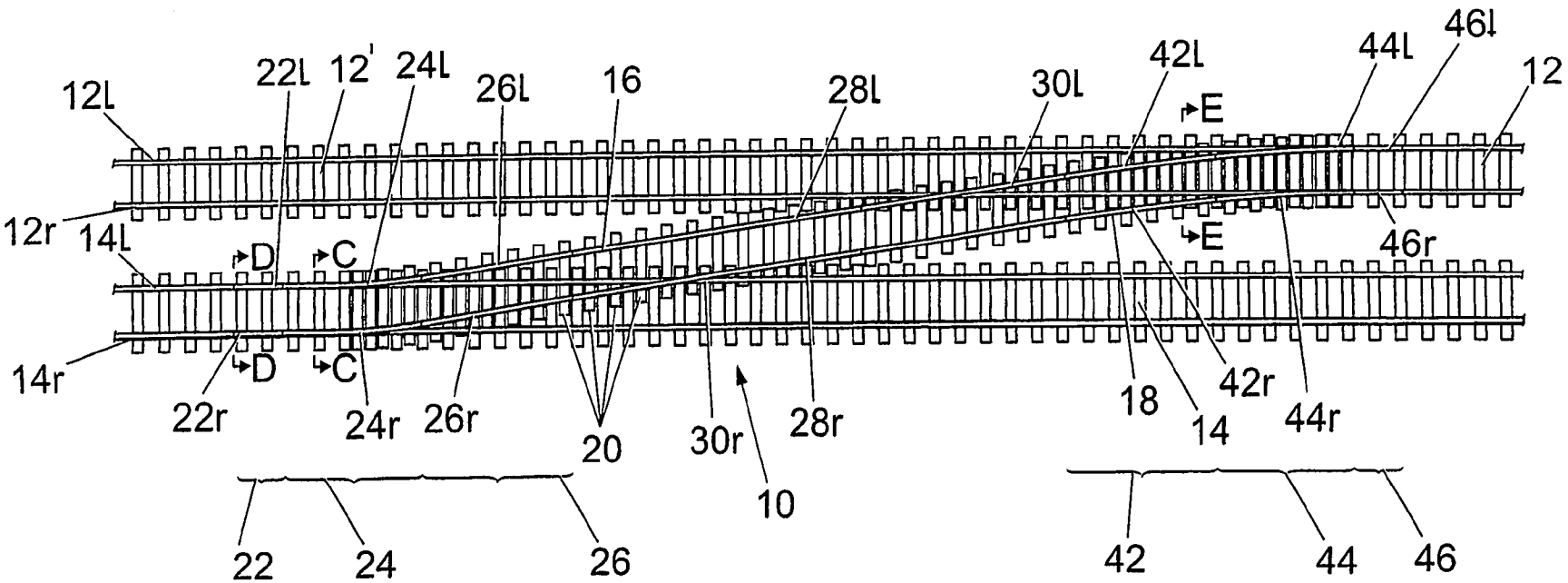
FIG. 1 is a plan view of a first embodiment of a temporary non-intrusive turnout in accordance with the present invention.

FIG. 1 shows a non-intrusive turnout generally indicated as 10 in accordance with a first embodiment of the present invention. It will be appreciated by the reader that two spaced apart non-intrusive turnouts 10 are utilised on a section of track to provide a non-intrusive crossover.

As shown in FIG. 1, the temporary non-intrusive turnout 10 links a south bound rail track 12 and a north bound rail track 14, such that a train (not shown) which has already been transferred from the south bound rail track 12 to travel south along the north bound rail track 14 can be transferred back onto the south bound rail track 12. In this manner, the portion of the south bound rail track 12' can be repaired/maintained. The skilled reader will realise that other routes of transfer could be installed and adopted.

The temporary non-intrusive turnout 10 comprises a number of components which will now be described.

The non-intrusive turnout 10 comprises a pair of turnout tracks 16, 18 and a plurality of temporary sleepers 20. For ease of reference, the turnout track 16 will be referred to as the left hand turnout track 16 and the turnout track 18 will be referred to as the right hand turnout track 18.

Figure 5:
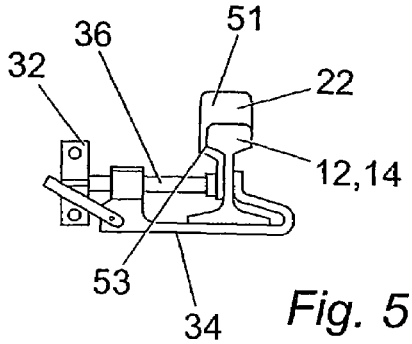
FIG. 5 is a close up view of a G-clamp of FIG. 7*a* indicated as detail 3.
Figure 25A:
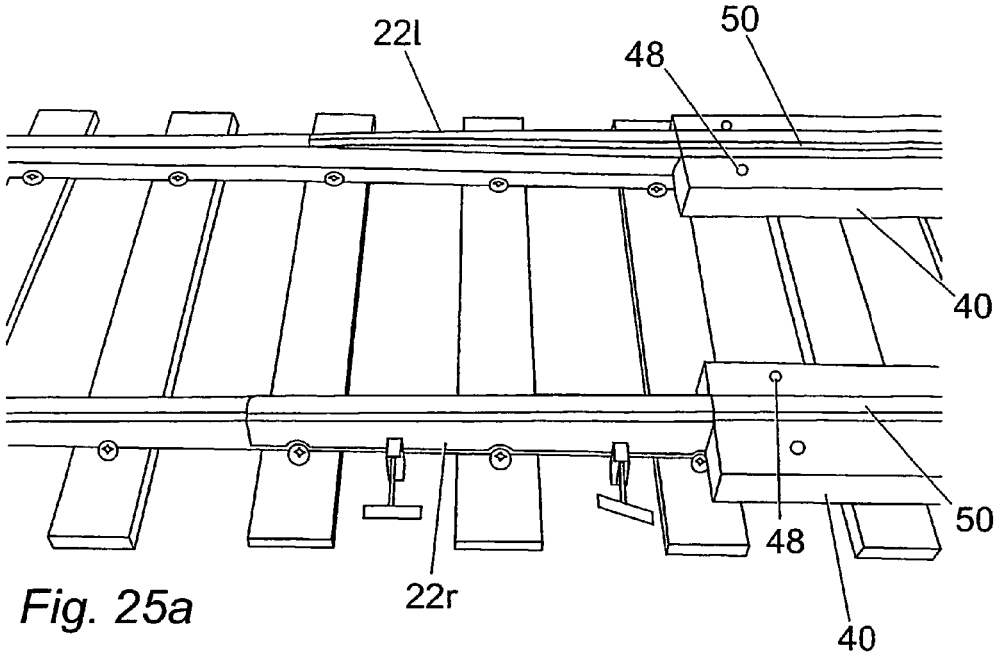
FIG. 25*a* is a side view of the ramp rails leading onto the switch rails of the turnout of FIG. 24*a;*
Figure 25B:
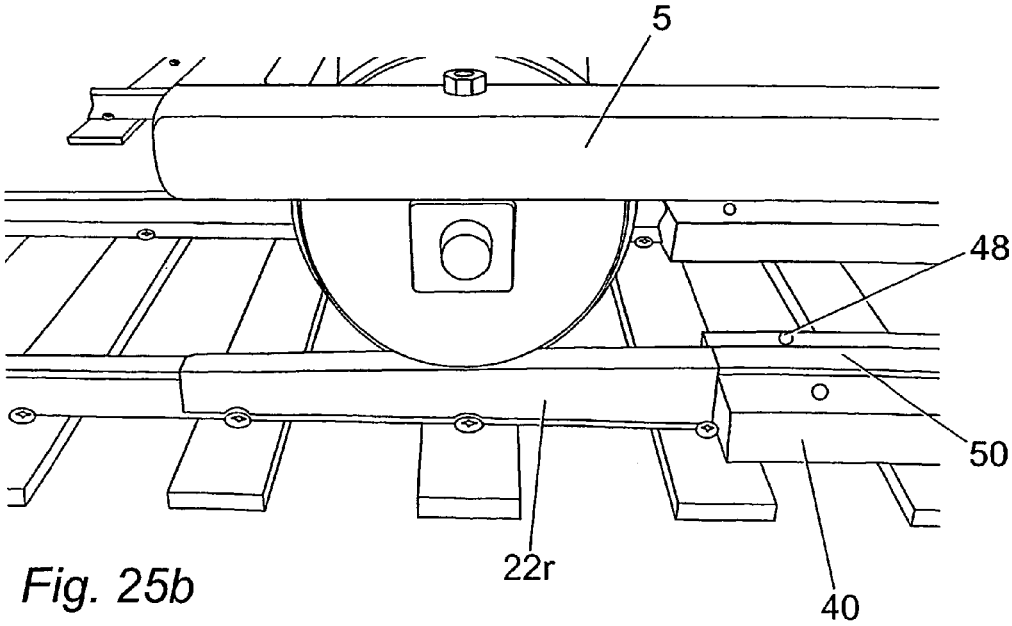
FIG. 25*b* is side view showing one of the train wheels mid-way up the ramp rail of FIG. 25*a;*
Figure 26:
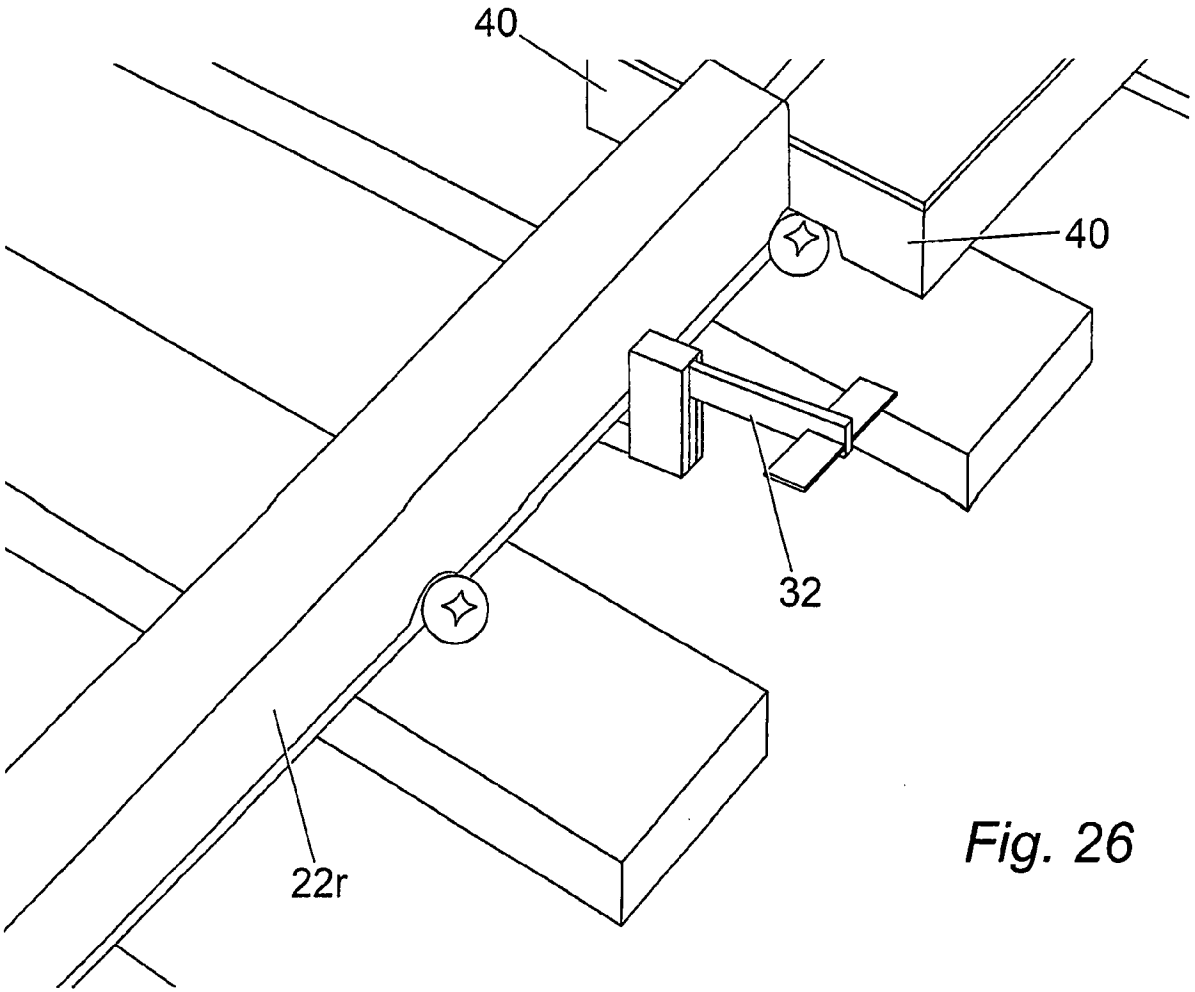
FIG. 26 is a perspective view showing the ramp rail and clamping mechanism.

The left hand turnout track 16 comprises, from the left hand end of FIG. 1, a ramp rail 22L. The uppermost portion of the ramp rail 22L is wedge shaped, with the uppermost surface tapering linearly from its left most end which has a height of 0 mm up to its right most end which has a height of approximately 50 mm and this linear tapering can be best seen in FIGS. 7B, 25A and 25B which shows that the ramp rail 22 has a sufficient length, in the region of 1700 mm, such that the angle of tapering is relatively gradual. The ramp rail 22L is coupled to the north bound left hand rail track 14L by means of a G-clamp mechanism 32 as shown in FIG. 5; it should be noted however that other types of clamp mechanisms could be utilised. The ramp rail 22 comprises a head portion 51 which rests on top of the upper flat surface of the rail track 12, 14. A neck portion 53 extends downwardly from the inner most edge of the head portion 51, where the neck portion 53 is shaped to substantially match the shape of the inside face of the rail track 12, 14.

The G-clamp mechanism 32 comprises a G-shaped clamp 34, one end of which surrounds and is compressed against, the opposite upstanding face of the rail track 12, 14 to the neck portion 53. A vice 36 extends toward the neck portion 53 of the ramp rail 22 from the other end of the G-shaped clamp 34, such that the vice 36 can be forced or urged into secure connection with the neck portion 53. Preferably, the vice 36 is of a type that can be readily assembled and disassembled in a short amount of time.

Figure 4:
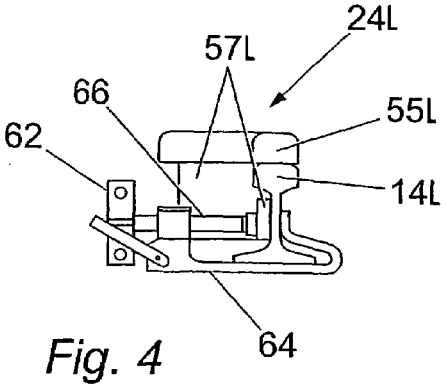
FIG. 4 is a close up view of a G-clamp indicated in FIG. 6 as detail 2.
Figure 6:
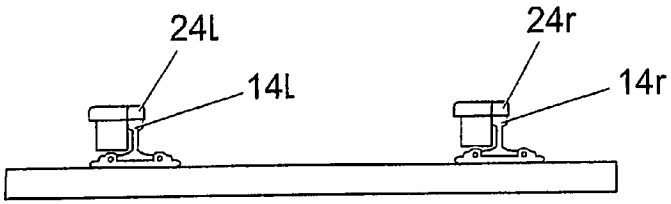
FIG. 6 is a cross-sectional view across section C-C of FIG. 1.
Figure 7B:
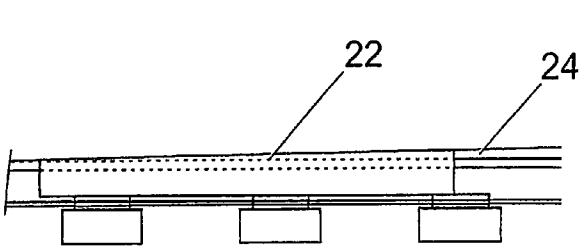
FIG. 7*b* is a side view of the portion of the turnout shown in FIG. 7*a;*
Figure 7A:
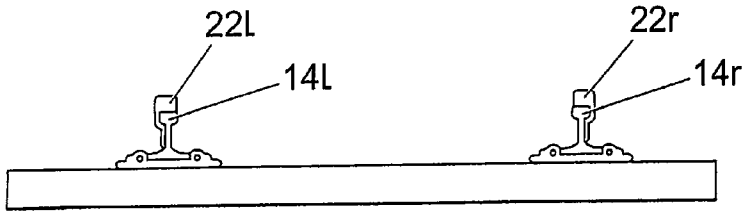
FIG. 7*a* is a cross-sectional view across section D-D of FIG. 1.

Following on from the ramp rail 22L from left to right, the left hand turnout track 16 next comprises a switch rail 24L, the left hand most end of which is arranged to butt against the right hand most end of the ramp rail 22L, as shown in FIG. 7*b*. As shown in FIG. 6, the switch rail 24L, 24R comprises a respective head portion 55L, 55R and the switch rail 24L, 24R is inwardly curved along its length, toward the south bound rail track 12 and thus away from the north bound rail track 14. In other words, the end of the switch rail 24L adjacent to the ramp rail 22L is located directly above the north bound rail track 14L whilst the opposite end of the switch rail 24L is displaced from the north bound rail track 14L. Nevertheless, the head portion 55L comprises a linear height of approximately 50 mm arranged horizontally along its length. The switch rail 24L also comprises a neck portion 57L. Conveniently, and as shown in FIG. 4, the neck portion 57L may have a slot formed in it at the end of the switch rail 24L closest to the ramp rail 22L, such that the upper most portion of the north bound rail track 14L can protrude inwardly through said slot. Alternatively, the slot may be omitted, with the neck portion 57L following the shape of the inside face of the north bound rail track 14L. The switch rail 24L is secured in a releasable fashion to the north bound rail track 14L by means of a G-clamp mechanism 62 which operates in a similar fashion to the G-clamp mechanism 32 of FIG. 5. The G-clamp mechanism 62 as shown in FIG. 4 comprises a similar G-shaped clamp 64 and a vice 66. The switch rail 24L is supported at its middle and right hand most end from underneath by the G-clamp mechanism 62 and temporary sleepers 20. It should be noted that the term "inside face" is used in the sense that it is the face that the respective turnout track 16, 18 is being turned away from.

Figure 8:
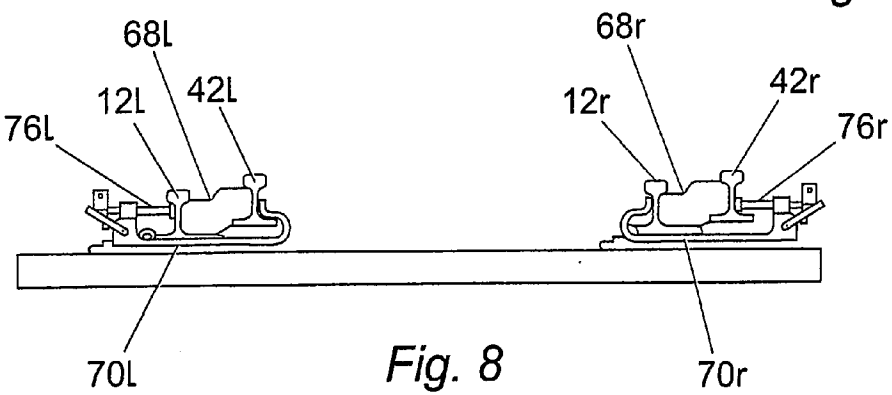
FIG. 8 is a cross-sectional view across section E-E of FIG. 1.

Following on from the switch rail 24L from left to right, the left hand turnout track 16 next comprises a gutt rail 26L. The gutt rail 26L has an I-shaped cross-section which is broadly similar to the I-shaped cross-section of a normal rail track such as 12, 14. The gutt rail 26L continues to bend at approximately the same radius as the bend radius of the switch rail 24L. The clamping mechanism of the gutt rail 26L to the north bound rail track 14L is similar to that as shown in FIG. 8 which will be described subsequently. Again, the gutt rail 26L is supported from underneath by the clamping mechanism and temporary sleepers 20 to have its upper flat horizontal surface to be approximately 50 mm above the south bound 12 and hence north bound 14 rail tracks.

Up until this point, the right hand turnout track 18 substantially mirrors that of the left hand turnout track 16, since the right hand turnout track 18 comprises, from left to right in FIG. 1, a ramp rail 22R, a switch rail 24R and a gutt rail 26R.

The left hand turnout track 16 from left to right after the gutt rail 26L comprises a straight rail 28L which thus has no bend radius and which once again is supported by the temporary sleepers 20 to have its upper flat horizontal surface to be approximately 50 mm above the south bound 12 and hence north bound 14 rail tracks.

Following immediately on from the straight rail 28L, the left hand turnout track 16 comprises a crossing rail 30L which is broadly similar to the crossing rail 30R which will be described subsequently.

Figure 2:
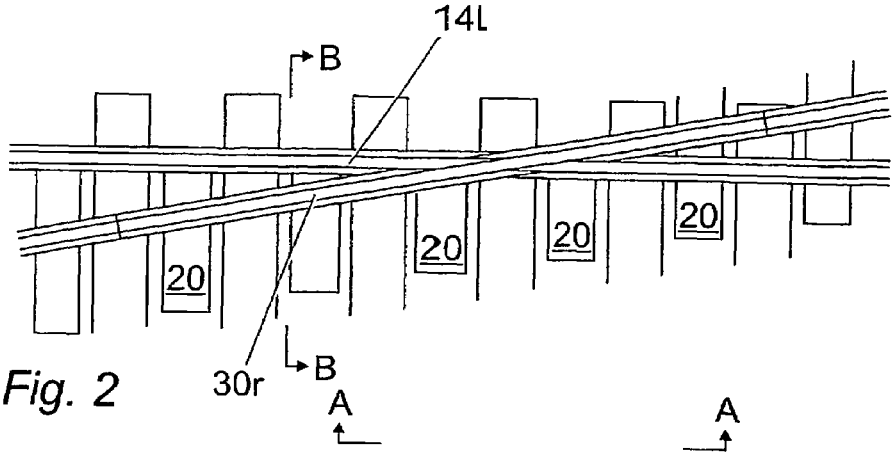
FIG. 2 is a plan view of a portion of the turnout of FIG. 1 highlighted as detail 1.
Figure 3A:
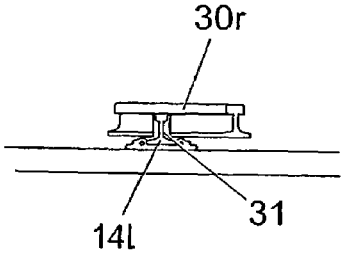
FIG. 3*a* is a cross-sectional view across section B-B of FIG. 2.
Figure 3B:
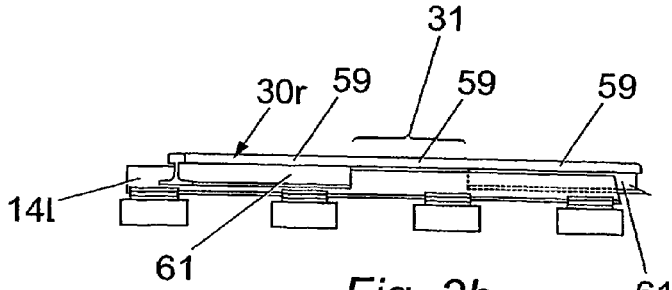
FIG. 3*b* is a side view of a portion of the turnout shown in the direction of A-A of FIG. 2.

Immediately following on from the gutt rail 26R, the right hand turnout track 18 comprises a crossing rail 30R which is shown in more detail in FIG. 2 and FIGS. 3A and 3B. The crossing rail 30R comprises a substantially I-shaped cross-section toward and at both its ends which is substantially the same I-shaped cross-section as the existing south bound 12 and north bound 14 rail track. Thus, towards and at its ends, the crossing rail 30R comprises a head portion 59 and a neck portion 61. However, a slot or gap 31 is provided along a portion of the length of the crossing rail 30R about the mid point of the crossing rail 30R such that there is no neck portion 61 in the region of the slot 31 as shown most clearly in FIG. 3B. The crossing rail 30R is arranged to lie across the north bound rail track 14L such that the north bound rail track 14L lies within the slot 31. Accordingly, since the crossing rail 30R is again supported from underneath by the temporary sleepers 20 to have its head portion 59 with a height of approximately 50 mm and since the crossing rail 30R is arranged to be horizontal, the upper most surface of the crossing rail 30R is approximately 50 mm higher than the upper most surface of the south bound 12 and north bound 14 rail tracks.

The right hand turnout track 18 next comprises from left to right and immediately after the crossing rail 30R, a straight rail 28R which is substantially identical in function and arrangement to the straight rail 28L previously described. Similarly, the crossing rail 30L is substantially identical to the crossing rail 30R in function and arrangement except that the crossing rail 30L crosses over the south bound rail track 12R.

The left hand turnout track 16 follows on from left to right after the crossing rail 30L with a gutt rail 42L which is followed by a switch rail 44L which is in turn followed by a ramp rail 46L which are respectively substantially identical to the gutt rails 26L, switch rail 24L and ramp rail 22L in function and arrangement.

The right hand turnout track 18 follows on from the straight rail 28R from left to right with a gutt rail 22R which is followed by a switch rail 44R which is in turn followed by a ramp rail 46R which are respectively substantially identical in function and arrangement to the gutt rail 26R, the switch rail 24R and the ramp rail 22R.

As shown in FIG. 8, the gutt rails 42L, 42R (and thus the gutt rails 26L, 26R) are clamped to the south bound rail tracks 12L, 12R by means of a J block arrangement 68L, 68R and a lengthened G-clamp mechanism 70L, 70R. The J block arrangement 68L and G-clamp mechanism 70L will now be described, but those skilled in the art will realise that the J block arrangement 68R and G-clamp mechanism 70R are substantially identical to the J block arrangement 68L and G-clamp mechanism 70L except that they are rotated through 180°. The gutt rail 42L is spaced apart from the south bound rail track 12L by means of the J block arrangement 68L which is preferably formed from any hard material that is shaped to fit into the heart of the rail to maintain a set distance between the rails. As shown in FIG. 8, the J block arrangement 68L is arranged such that it not only spaces the gutt rail 42L horizontally apart from the south bound rail track 12L but it also spaces them vertically apart, such that the upper most horizontally arranged surface of the gutt rail 42L is approximately 50 mm vertically above the upper most horizontally arranged surface of the south bound rail track 12L. The G-clamp mechanism 70L clamps the gutt rail 42L to the south bound rail track 12L via the J block arrangement 68L and the G-clamp mechanism 70L once again comprises a vice 76L or a bolted fixing through the rail 12L, 42L and J block arrangement 68L or similar arrangement.

Figure 9B:
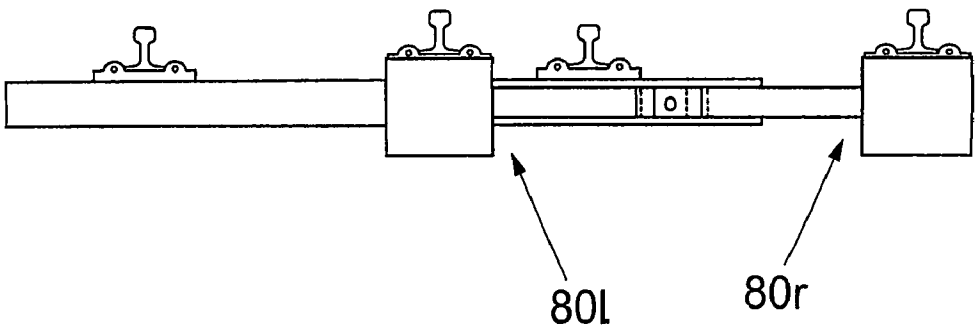
FIG. 9*b* is a cross-sectional view across section F-F of FIG. 9*a;*
Figure 9A:
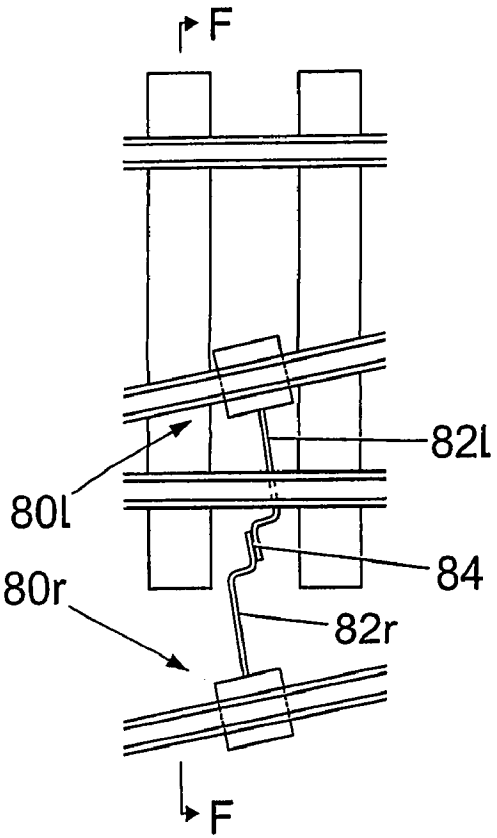
FIG. 9*a* is a close up plan view of the portion of the turnout indicated in FIG. 1 as detail 4.

It should be noted that, as shown in FIG. 9A, the left hand 16 and right hand 18 turnout tracks may be provided with a pot sleeper arrangement 80, where the two pot sleeper arrangements 80L, 80R are coupled to one another via a rigid frame 82L, 82R, where the rigid frame 82L, 82R may be provided in two halves, 82L, 82R which are coupled to one another at their outer most ends via a suitable fixing means 84 such as nuts and bolts (not shown).

Figure 32A:
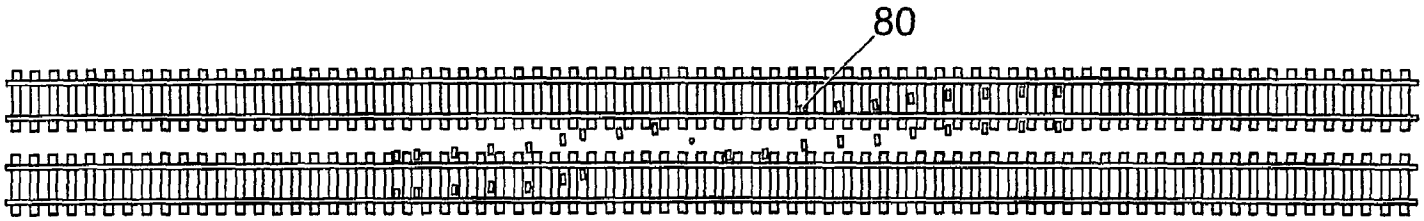
FIG. 32*a* is a plan view showing the layout of the pot sleepers of FIG. 24*c;*
Figure 32C:
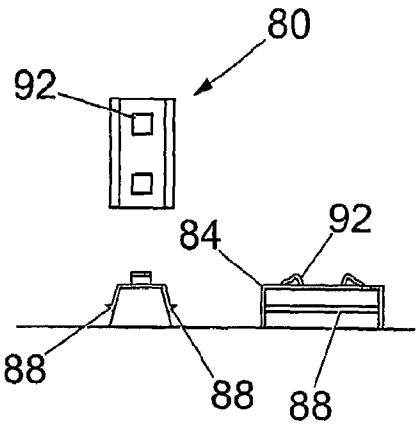
FIG. 32*c* shows an end, side, and plan view of the pot sleeper arrangement of FIG. 24*c;*
Figure 32B:
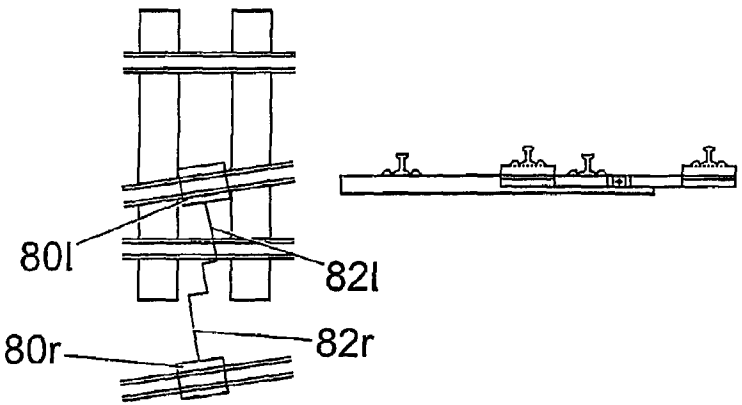
FIG. 32*b* is a plane view showing two pot sleeper arrangements of FIG. 24*c* connected by a rigid frame.
Figure 33A:
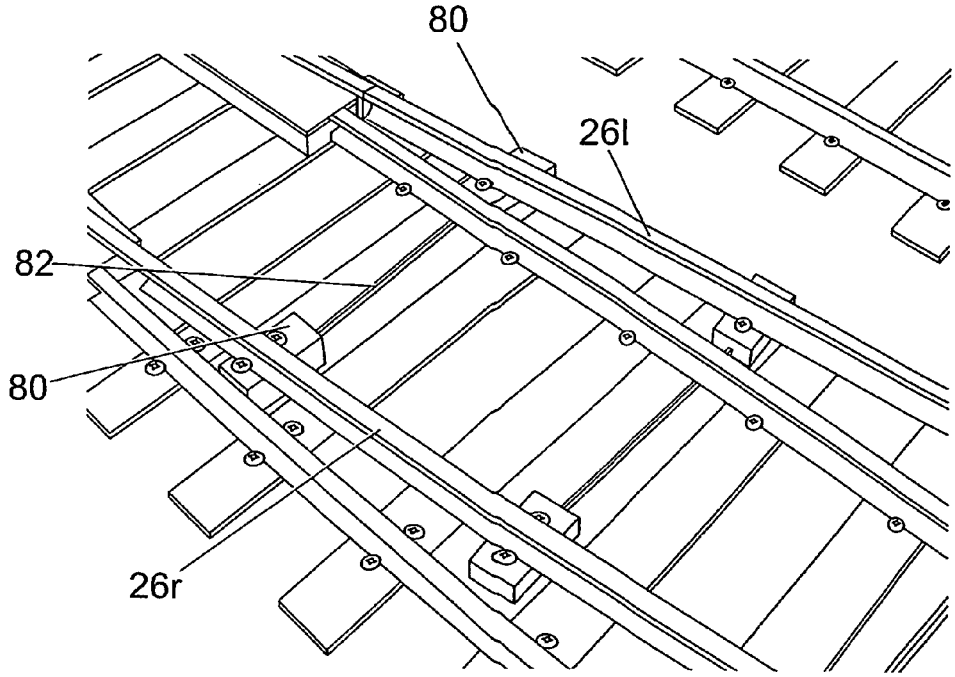
FIG. 33*a* is a perspective view showing the pot sleeper and rigid frame arrangements of FIG. 32*b* in their operational position.

Thus, the pot sleeper arrangement 80L, 80R can be used either to replace the temporary sleepers 20 (as shown in FIGS. 32A and 33A) or could be provided on top of an in-situ or existing timber sleeper, in order to provide increased rigidity to the non-intrusive temporary turnout 10.

Figure 33B:
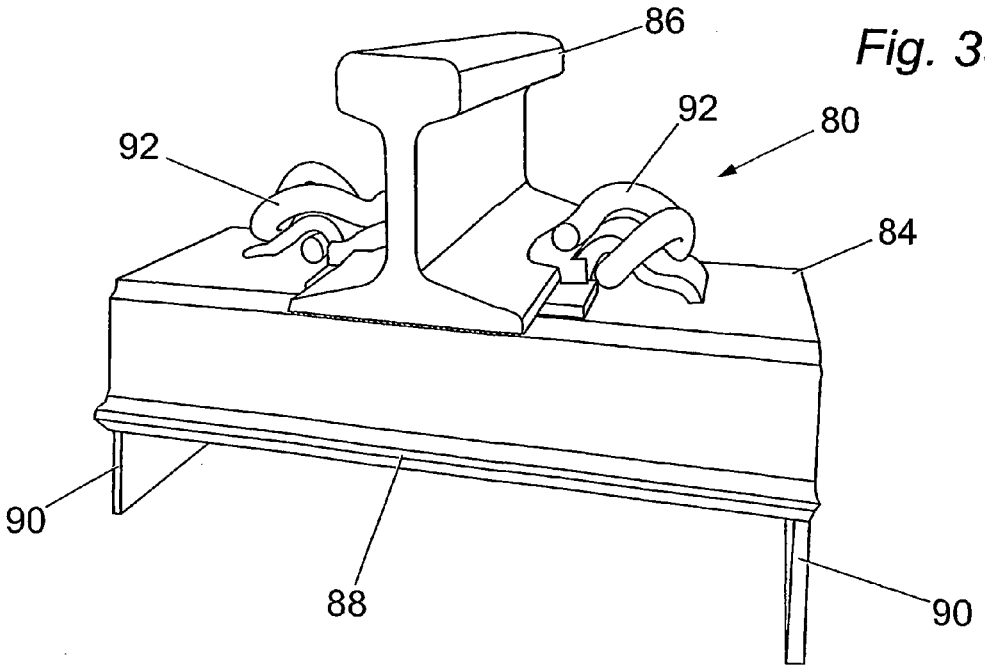
FIG. 33*b* is a perspective view of the pot sleeper arrangement of FIG. 24*c* with a sample rail section fixed thereto.
Figure 35B:
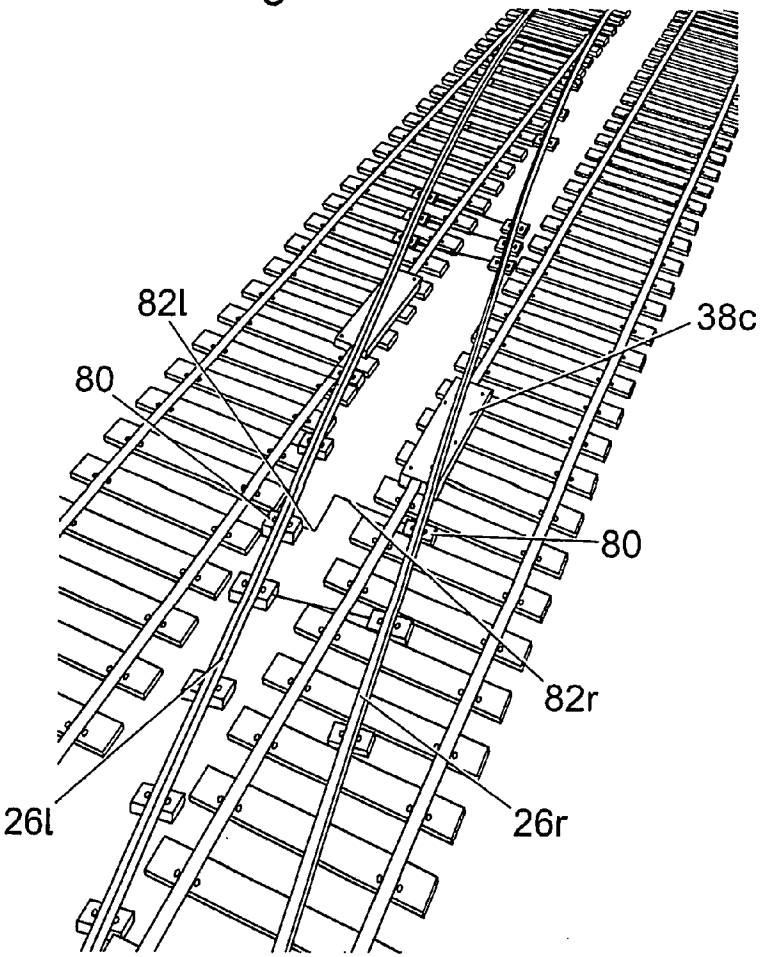
FIGS. 35*a* and 35*b* are perspective view photographs showing the layout of the pot sleeper arrangements of FIG. 24*c*.
Figure 35A:
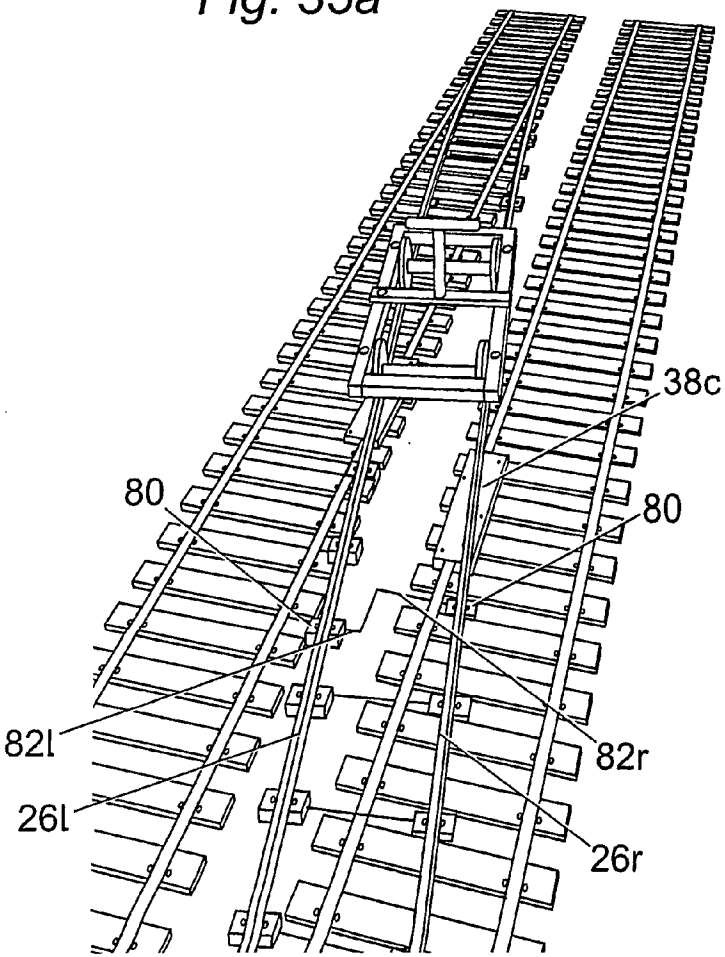

The pot sleeper arrangement 80 is shown in more detail in FIGS. 33B and 34A with a sample rail section 86 fixed in position. The beam section 84 of the pot sleeper 80 has a hollow, inverted U-shaped cross section which is toed out at the lowermost end of each side of the inverted, U-shape to form lips 88. End plates 90 are attached to each end of the beam section 84 such that each end plate 90 protrudes vertically downward past the lips 88, the downward projection typically being in the region of 100 mm. The sample rail section 86 is connected to the beam section 84 by conventional 'Pandrol' clips 92 which are known widely in the railway industry.

When the pot sleepers 80 are in position, the end plates 90 project into the ballast or stones(not shown in FIG. 33B) until the lips 88 are level with the ballast (not shown). This projection of the plates 90 provides increased lateral stability to the pot sleepers 80 in both the longitudinal and perpendicular directions with respect to the main axis of the pot sleepers 80, whilst keeping the mass of the pot sleeper arrangement 80 to a minimum. The lips 88 also create a larger surface area or footprint for the pot sleeper 80 which avoids it sinking into the ballast (not shown) beyond a satisfactory depth when a load is placed on the pot sleeper 80 (i.e. during the passing of a train 5).

Figure 10:
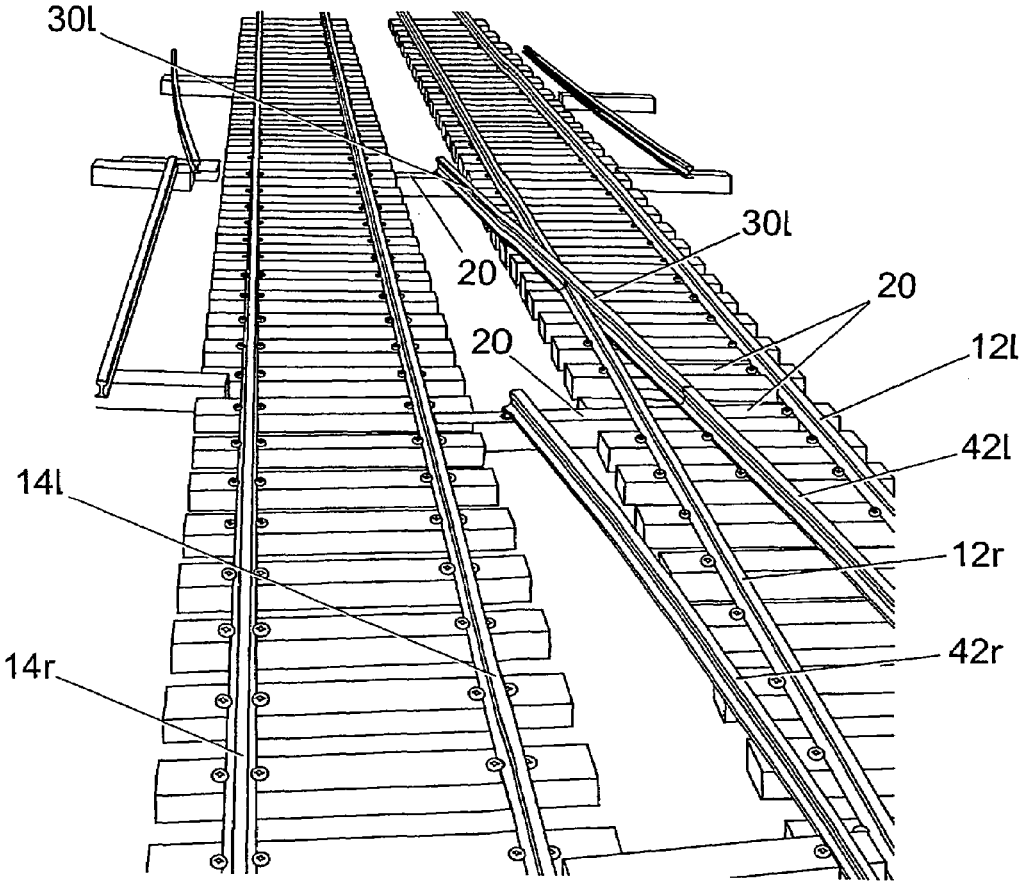
FIG. 10 is a perspective view of a scale model of a temporary non-intrusive turnout, substantially identical to the embodiment shown in FIG. 1 in accordance with the present invention during installation.

FIG. 10 shows a scale model of a non-intrusive turnout 10 part way through construction; it should be noted however that the scale model shown in FIG. 10 omits the straight rails 28L, 28R and also the switch rails 44L, 44R but it is envisaged that the straight 28L, 28R and switch 44L, 44R rails would be used in a full size rail track 12, 14.

Figure 11:
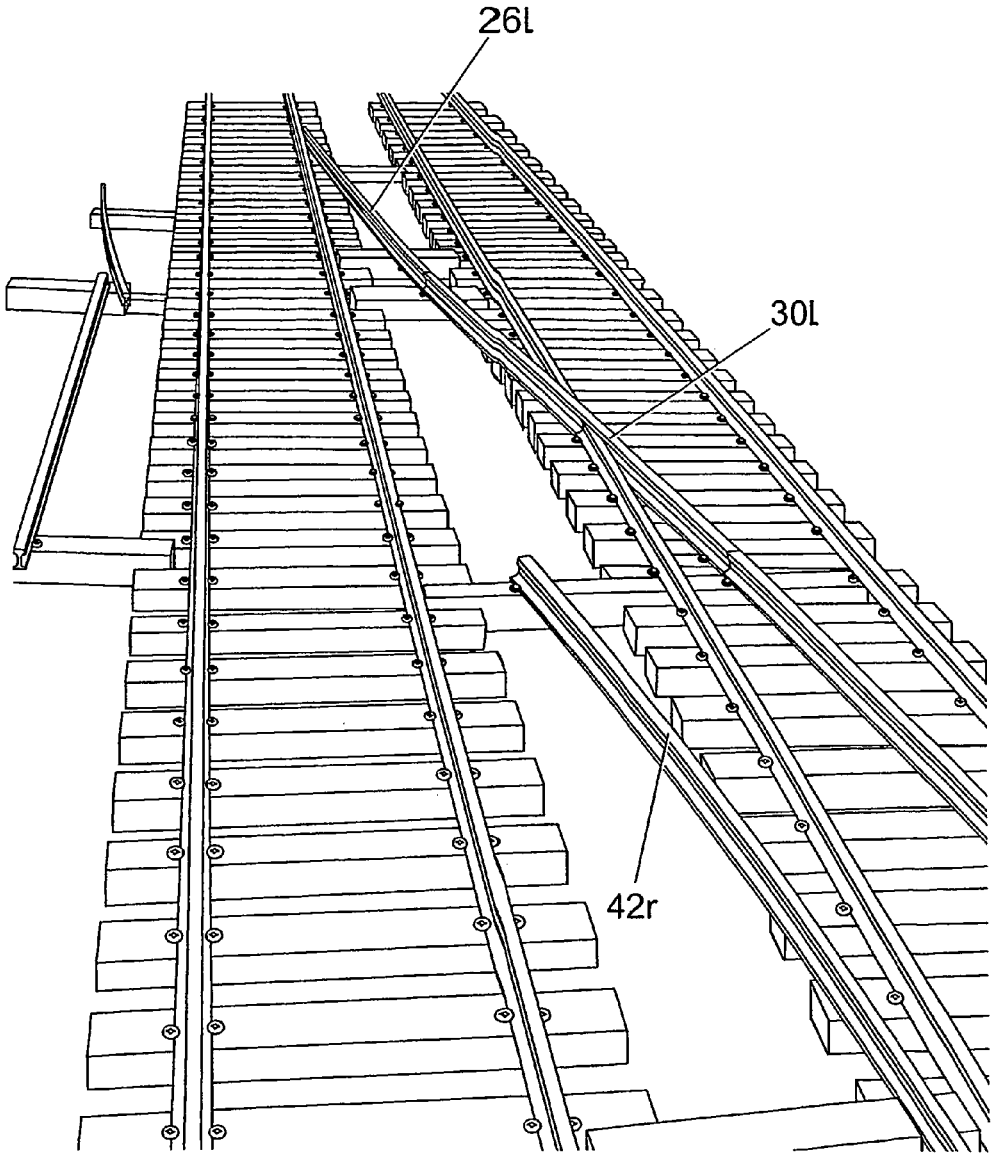
FIG. 11 is a perspective view of the turnout section of FIG. 10 further on during construction.
Figure 12:
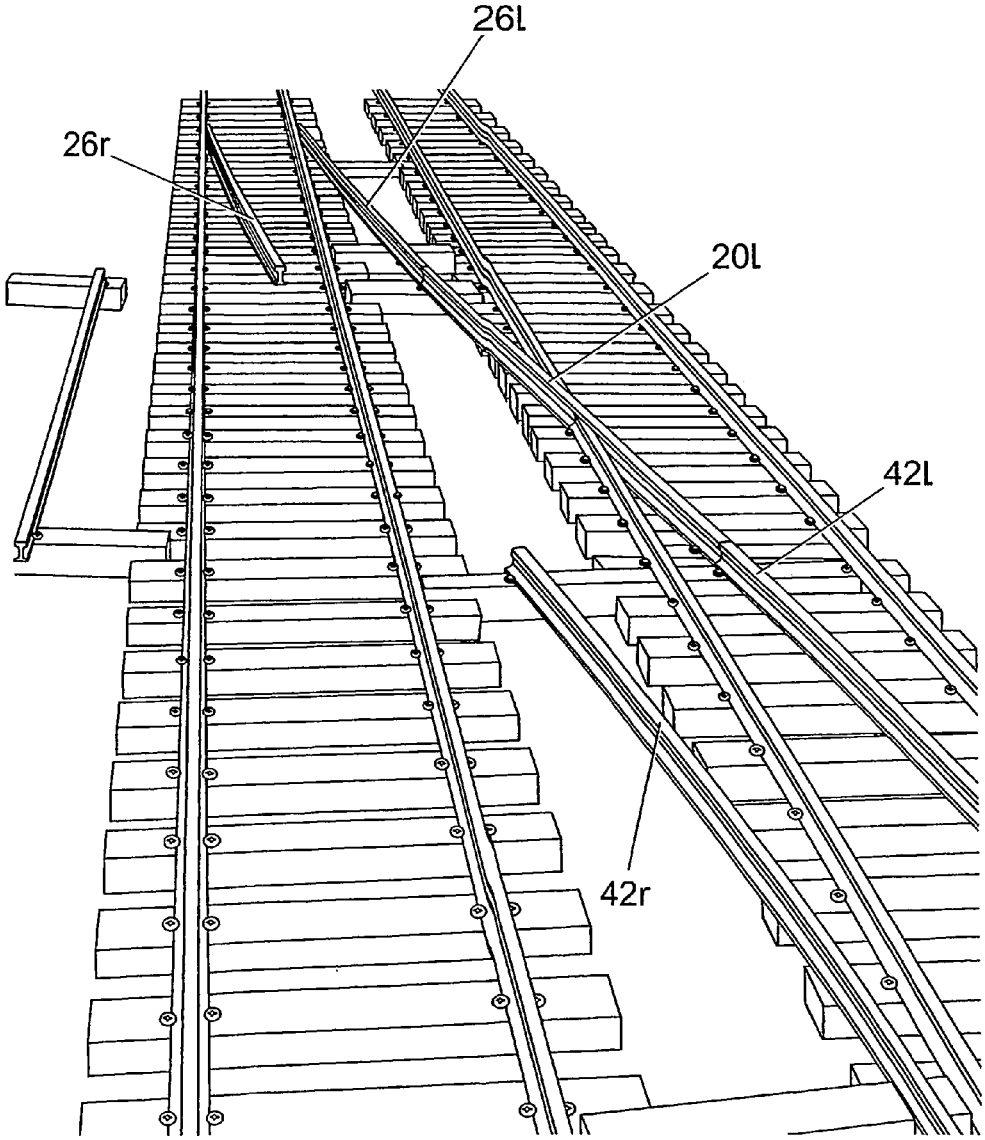
FIG. 12 is a perspective view of the turnout section of FIG. 11 further on during construction.
Figure 13:
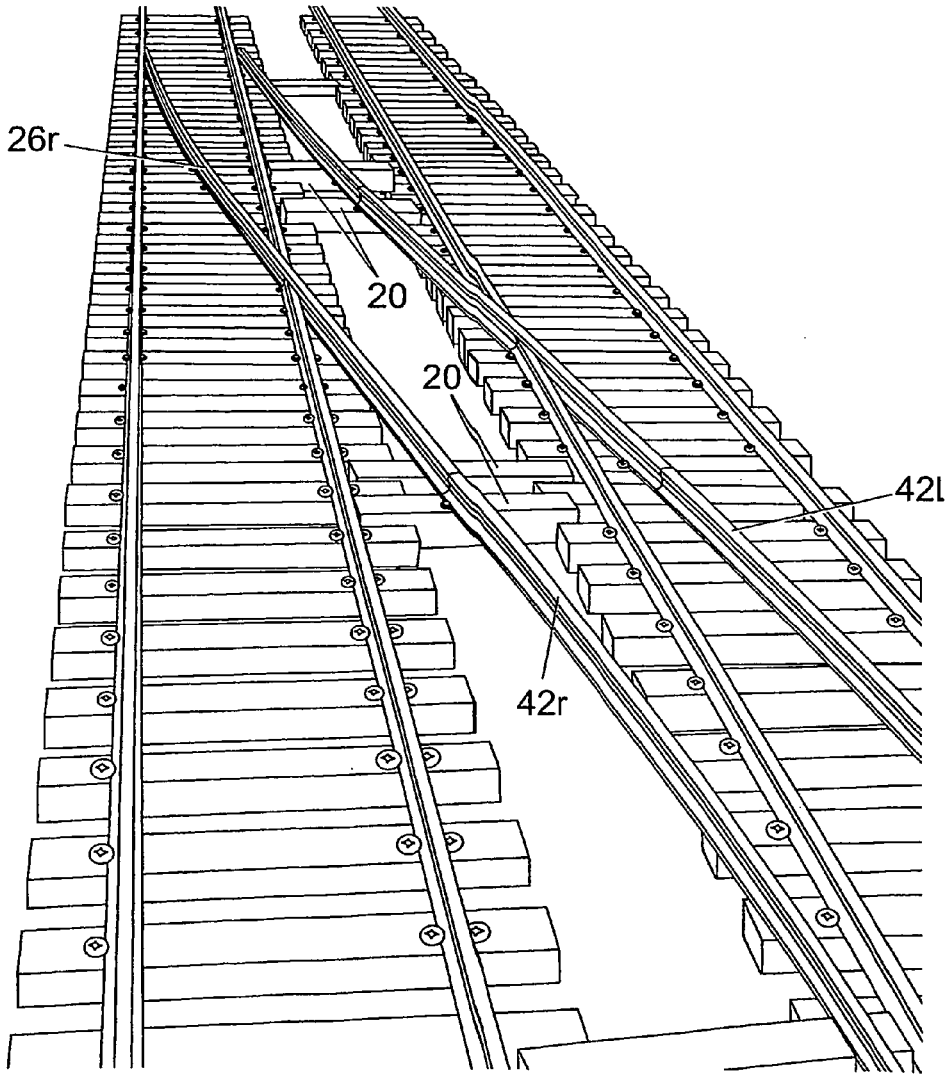
FIG. 13 is a perspective view of the turnout section of FIG. 12 further on during construction.
Figure 14:
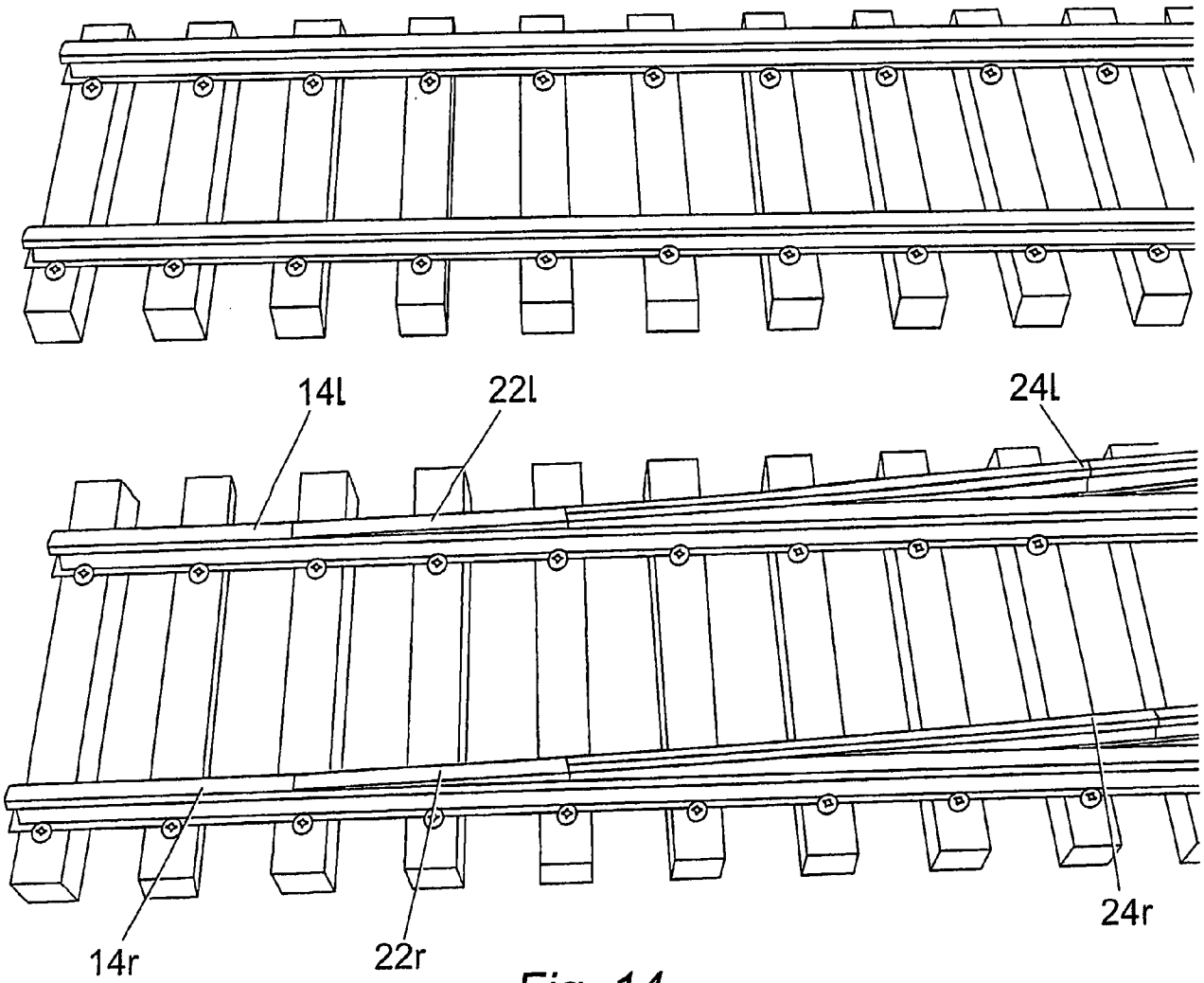
FIG. 14 is a plan view of one end of the turnout section of FIG. 13.

FIG. 10 shows that a couple of temporary sleepers 20 have been laid, and the gutt rails 42L, 42R have been secured to the temporary sleepers 20 and also secured to the south bound track 12L, 12R. It should also be noted that the gutt rails 42R are in essence longer versions of the switch rails 44L, 44R in the model shown in FIG. 10 through FIG. 18. The crossover rail 30L has also been installed such that it crosses over the south bound rail track 12R. FIG. 11 shows that the gutt/switch rail 26L has been installed next and is followed by installation of the gutt/switch rail 26R in FIG. 12 and is followed by the crossover rail 30R as shown in FIG. 13. Thereafter, the ramp rails 22L, 22R are secured to the respective north bound rail tracks 14L, 14R.

Figure 15:
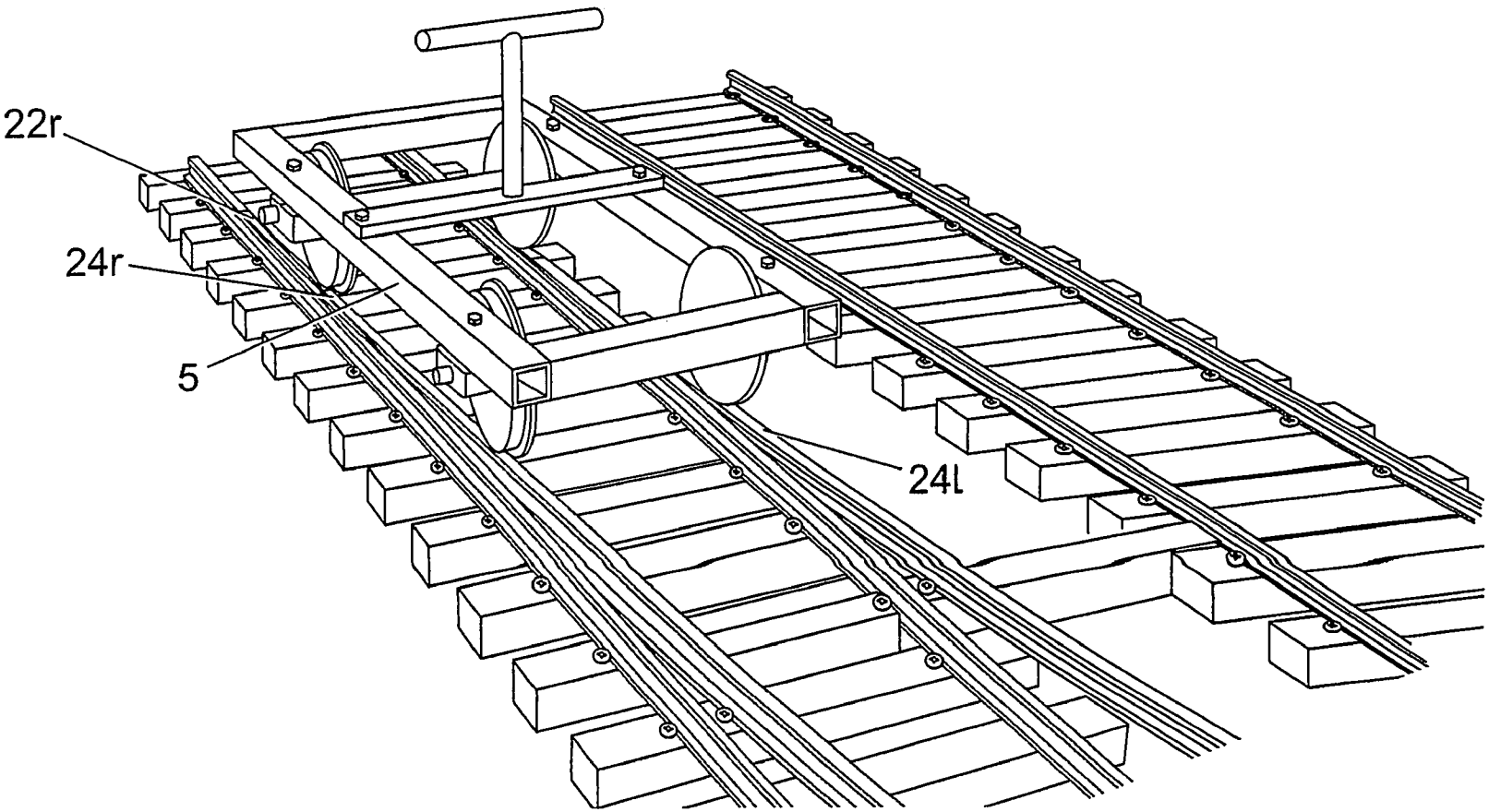
FIG. 15 is a perspective view of a model representing a train as it enters the turnout section of FIG. 14.
Figure 16:
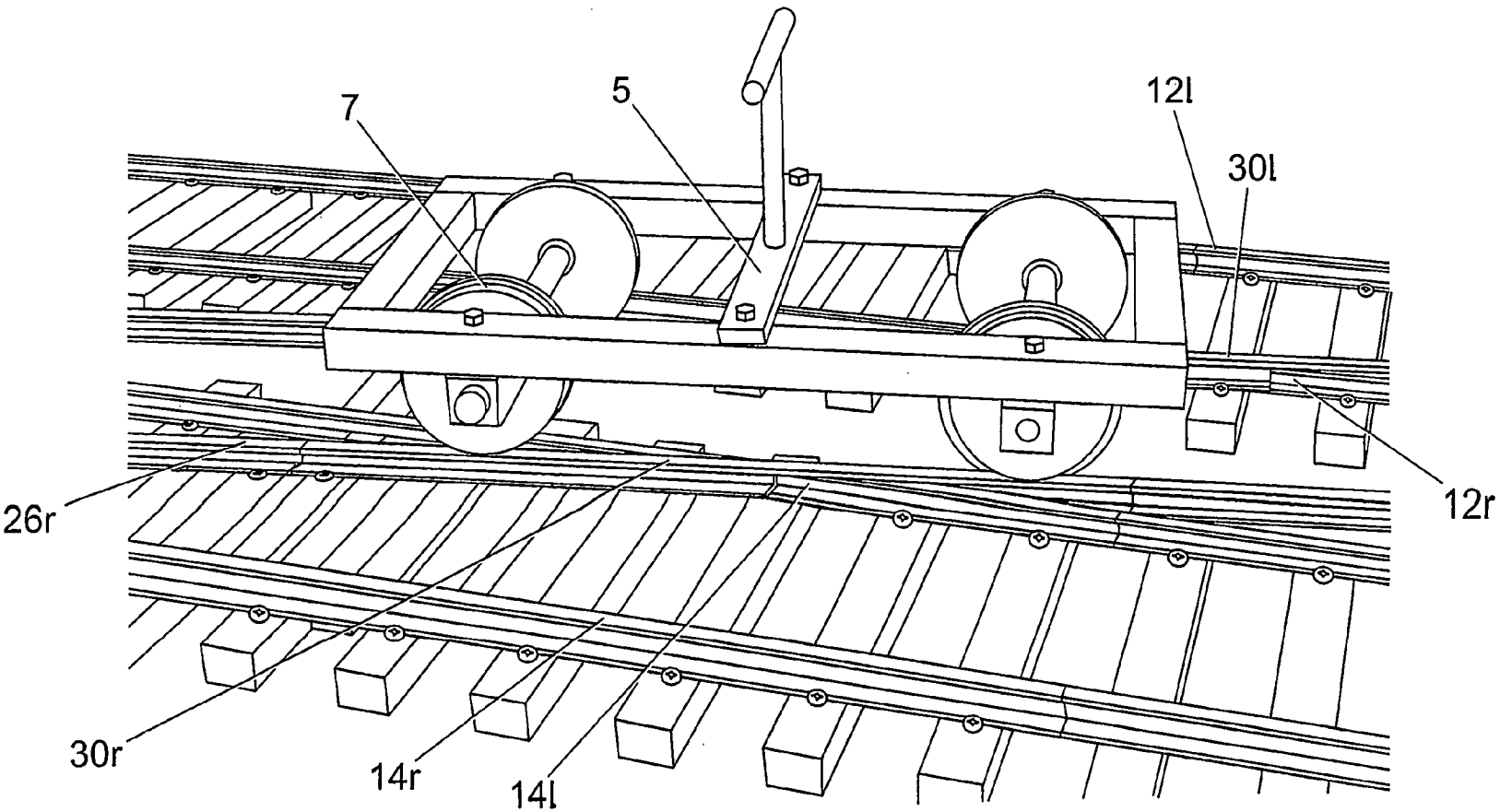
FIG. 16 is a perspective view of the model of FIG. 15 as it progresses through the turnout section.
Figure 17:
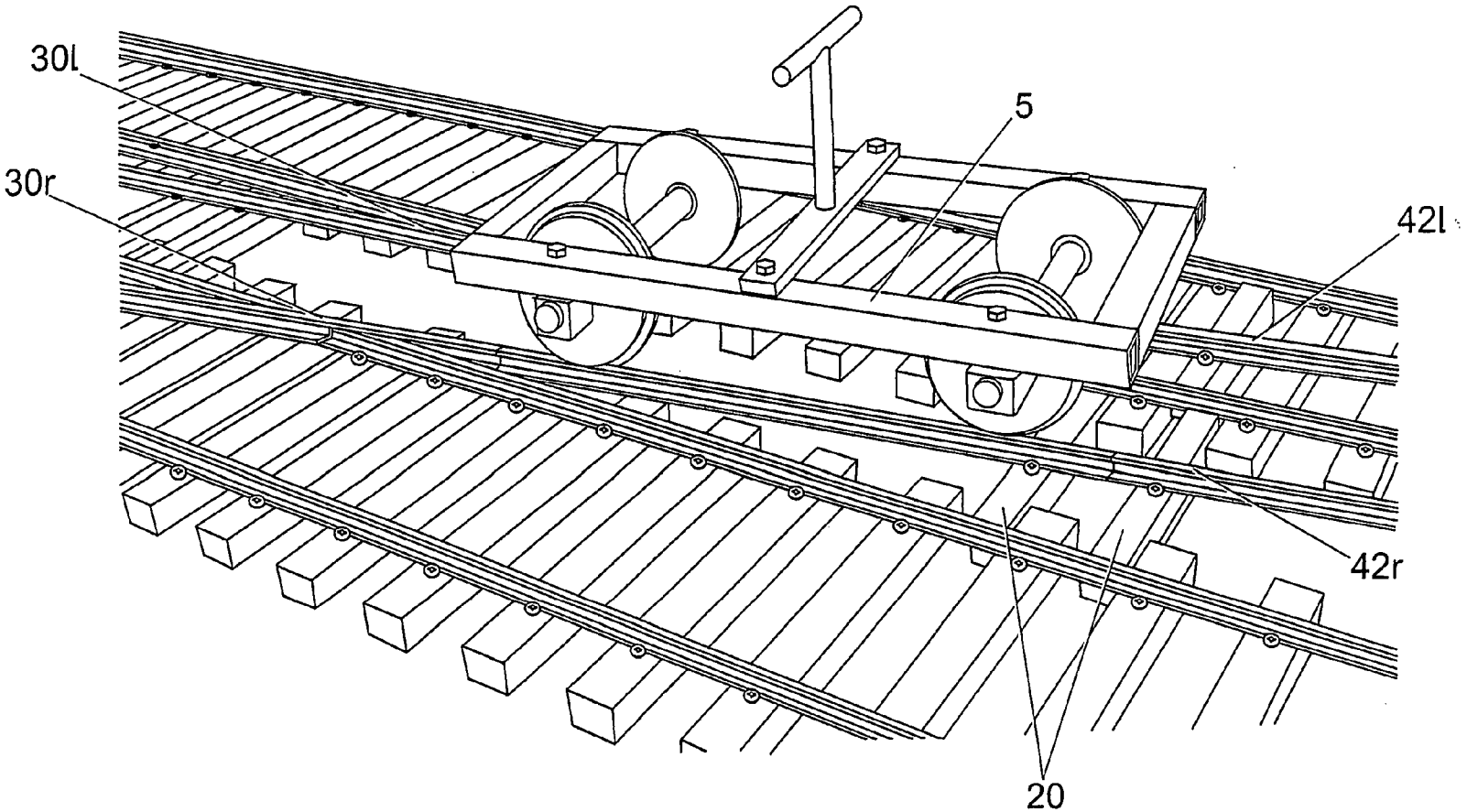
FIG. 17 is a perspective view of the model of FIG. 16 as it progresses further through the turnout section.
Figure 18:
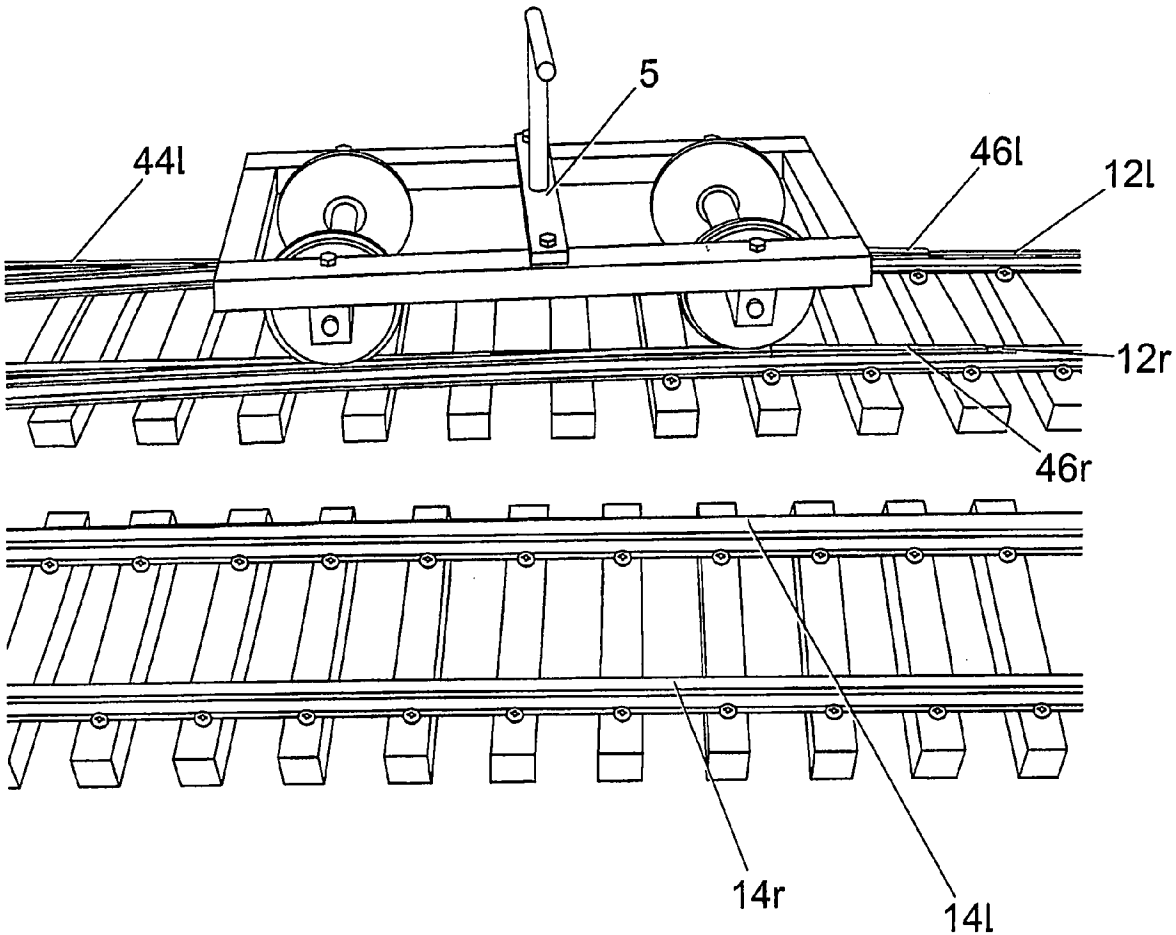
FIG. 18 is a perspective view of the model of FIG. 17 as it nears the end of the turnout section.

A model of a train 5 is shown in FIG. 15 as having travelled south along the north bound rail track 14 and having mounted the ramp rails 22L, 22R. It is important to note that the ramp rails 22L, 22R raise the wheels of the train (not shown) and thus the model train 5 by an amount sufficient such that the flanged part of the wheel is just vertically above the height of the rest of the normal track 14L, 14R. Thus, and as shown in FIG. 16, when the model train 5 moves onto the crossing rails 30L, 30R, the left hand 16 and right hand 18 turnout tracks are of a sufficient height such that the flanged part of the wheel 7, which normally acts to keep the model train 5 and thus full size trains on the tracks, is able to clear the north bound rail track 14L and then the south bound rail track 12R. The model 5 is shown in FIG. 17 as continuing through the non-intrusive temporary turnout 10 until it reaches the position shown in FIG. 18 which shows the model 5 about to travel down the ramp rails 46L, 46R and then onward as per normal south along the south bound rail track 12.

The embodiment of the non-intrusive turnout 10 described herein has the great advantage that the rail tracks 12R and 14L do not require to be cut which would be normal if a conventional intrusive temporary turnout was to be inserted in to the tracks 12, 14. Furthermore, those skilled in the art will appreciate that, if a train requires to pass through the non-intrusive temporary turnout 10 without actually crossing over from one track 12 onto another track 14, the ramp rails 22 or 46 as required can be removed along with the respective switch rails 24 or 44 and crossing rail 30L or 30R and as such the train will be able to bypass the non-intrusive temporary turnout 10.

A non-intrusive turnout in accordance with an alternative and preferred embodiment of the present invention will now be described with reference to FIGS. 19 to 35.

The sequence of rail components length wise along the track of the turnout of FIGS. 19 to 35 is the same as that for the previous embodiment (FIG. 1) i.e. from the left hand end of the left hand turnout track 16, a pair of ramp rails 21, 22 followed by a pair of switch rails 23, 24 followed by a pair of gutt rails 25, 26, followed by a pair of crossing rails 29, 30 etc.

The ramp rails 21, 22 and the means of connecting the ramp rails 21, 22 (G-clamp mechanism 32, represented by 32 in FIG. 26) in this embodiment are broadly similar to that of the previous embodiment, and thus require no further description.

Figures 19A, 19B, 19C, 19D, 19E, 19F:
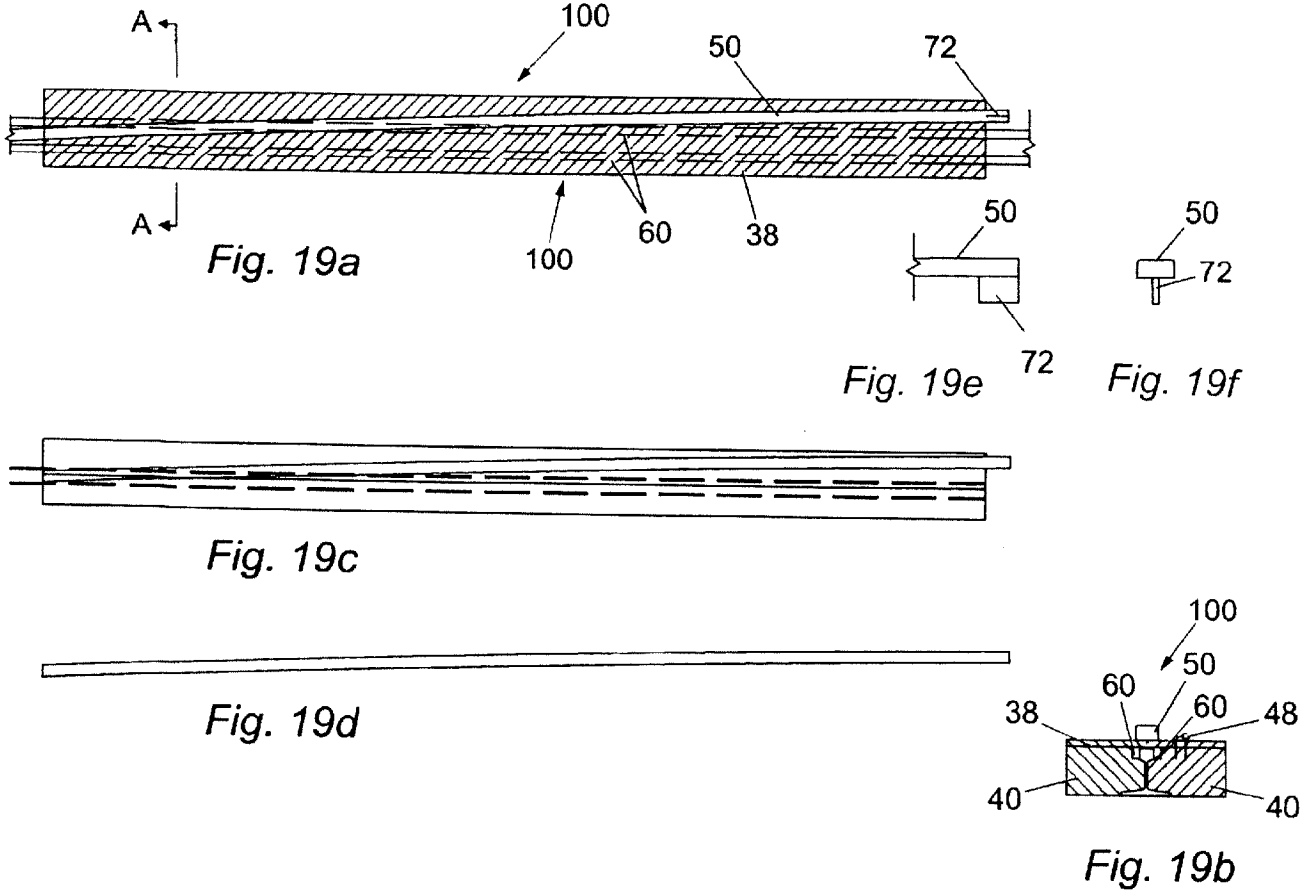
FIG. 19*a* is a plan view of an alternative and preferred embodiment of a switch rail to that shown in FIG. 1, where the switch rail is mounted on a support plate.
FIG. 19*b* is a cross-sectional view of the switch rail of FIG. 19*a;*
FIG. 19*c* is a plan view of the switch rail and support plate of FIG. 19*a;*
FIG. 19*d* is a side view of the support plate of FIG. 19*a;*
FIG. 19*e* is a side view of an end of the switch rail of FIG. 19*a;*
FIG. 19*f* is an end view of the end of the switch rail of FIG. 19*e;*
Figure 24A:
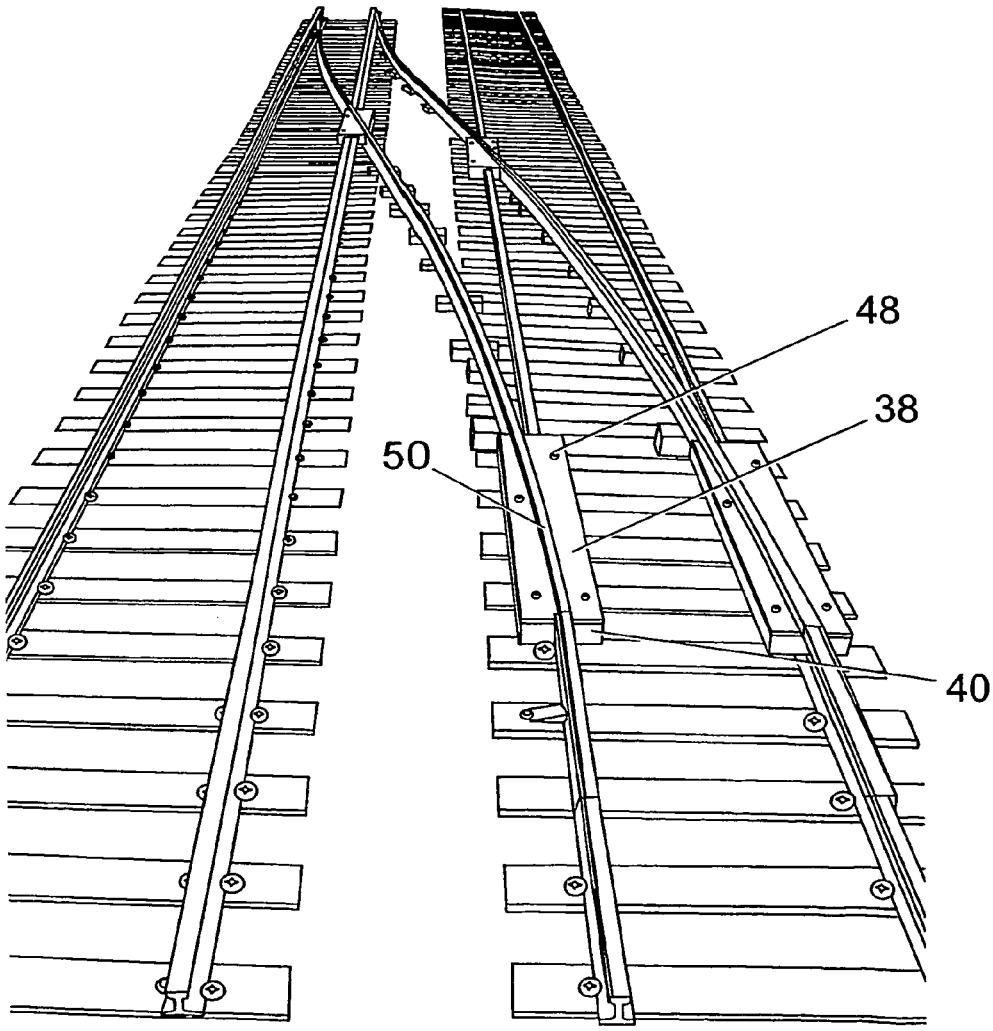
FIG. 24*a* is a perspective view of a further alternative and preferred embodiment of a turnout in accordance with the present invention.
Figure 24C:
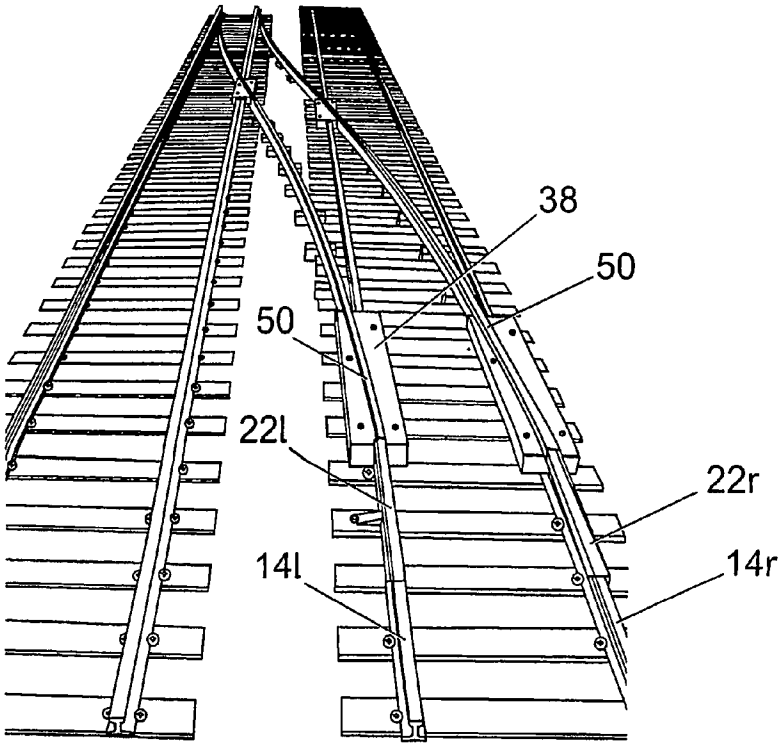
FIG. 24*c* is a perspective view of the temporary turnout of FIG. 24*a*, also showing an arrangement of pot sleepers in accordance with a third aspect of the present invention.
Figure 24B:
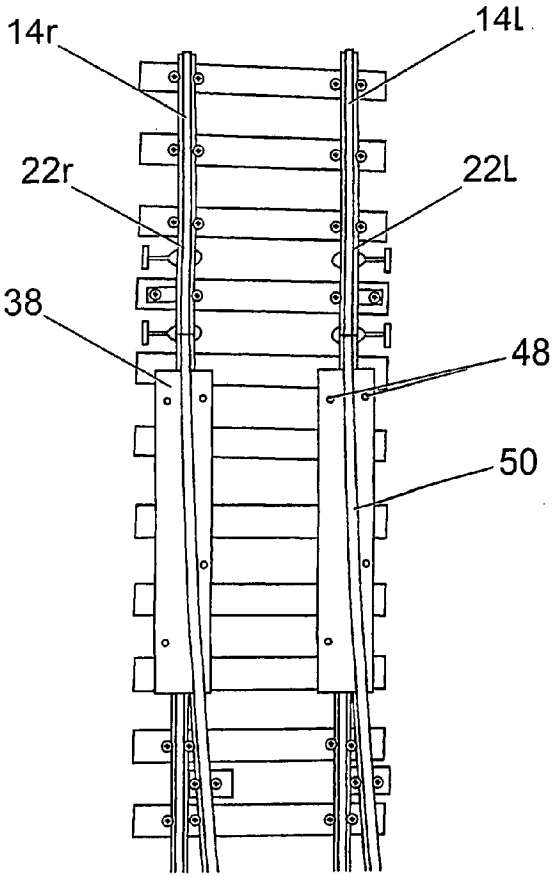
FIG. 24*b* is a plan view of the switch rail and ramp rails and associated level crossing support members of the turnout of FIG. 24*a;*

Following on from the ramp rails 21, 22, FIGS. 19A and B along with FIGS. 24A, B, C) shows a pair of switch rail units generally designated 100 comprising a switch rail head 50, planar member or plate 38, guide means 60 in the form of downwardly projecting guide flanges 60, a pair of supporting members 40, end plate 72, and support connecting means 48 in the form of clips 48.

The switch rail head 50 essentially takes the form of an upper portion of an I-shaped rail section (shown during installation of the apparatus in FIGS. 31A and B), and extends between one end of the switch rail unit 100 and the other. The switch rail head 50 is inwardly curved along its length toward the south bound rail track 12 and thus away from the north bound rail track 14, in a broadly similar manner to the previous embodiment (FIG. 1).

Figure 27A:
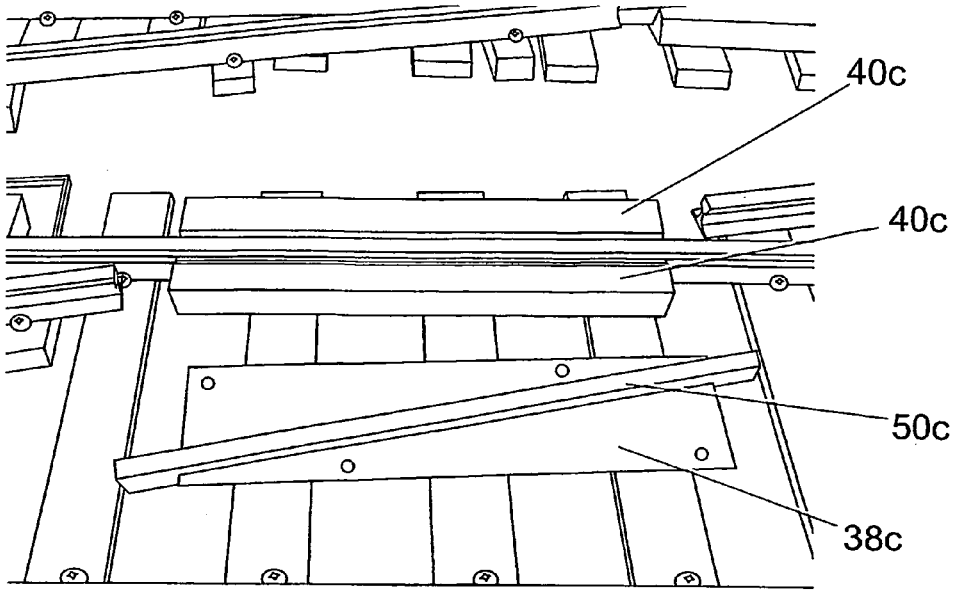
FIGS. 27*a* and 28*a* are perspective view photographs showing the crossing rail of FIG. 24*a* during installation.
Figure 28A:
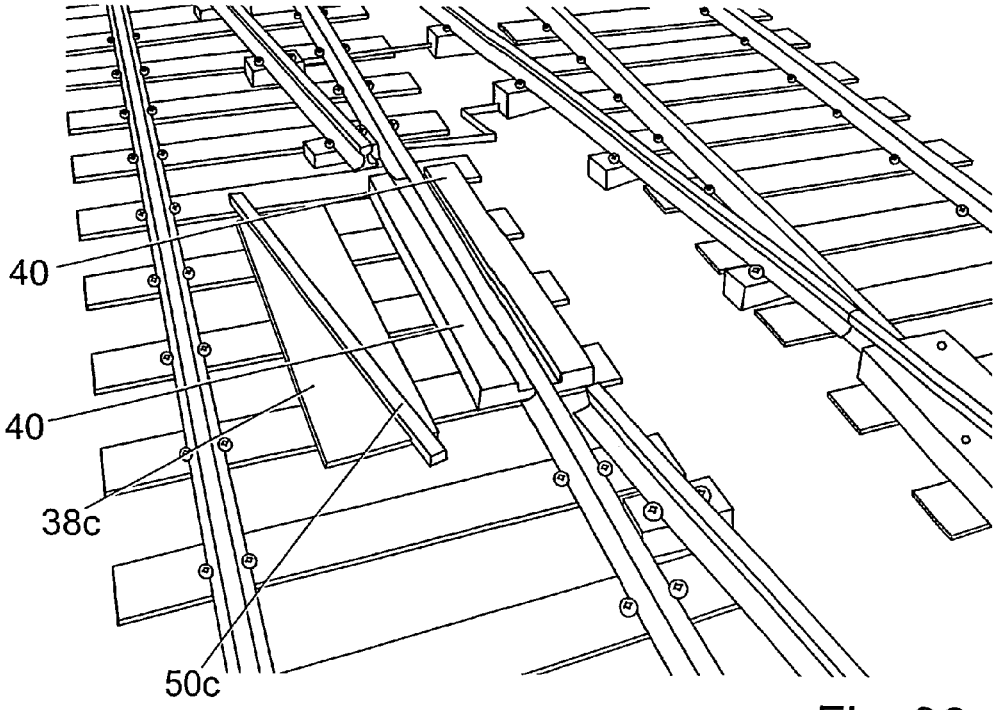

The planar member or plate 38 is rectangular in dimension and is permanently attached to the switch rail head 50 by any suitable means during manufacture such as welding or moulding etc. The plate 38 may or may not extend along the full length of the switch rail unit 100; in the latter case, the switch rail head 50 will overhang the plate member 38. This is best seen in FIGS. 27A and 28A.

The pair of guide flanges 60 project downwardly from the plate 38 and run parallel to the existing north bound track 14 along the entire length of the switch rail unit 100 and are displaced from the centreline or the plate 38 by an amount which allows the inner track of the existing north bound track 14 to fit closely between the pair of guide flanges 60. The skilled reader will realise that the guide flanges 60 may only be present at the extreme ends of the plate 38.

Each supporting member 40 may be a wooden timber and has a cross sectional shape which allows them to be placed underneath the plate 38 and close around the inner and outer neck portions of the existing rail. The lower surface of each supporting member 40 together may also be adapted, during manufacture or upon installation, to match the contours of a variety of standard railway sleepers. The pair of supporting members 40 are of a length, width and position, substantially similar to that of the plate 38, though it will be appreciated that longer and or wider supporting members may be preferable depending upon the individual situation parameters, for example the alignment and or size of the gaps between sleepers.

The clips 48 releasably attach the pair of supporting members 40 to the plate 38, and are designed such that they will hold the supporting members 40 firmly against the planar member 38 in the vertical direction, and against the existing rail in the lateral direction.

The end plate 72 protrudes vertically downward from the overhang created by the switch rail head 50 and butts against the end of the inner supporting member 40.

Figure 29B:
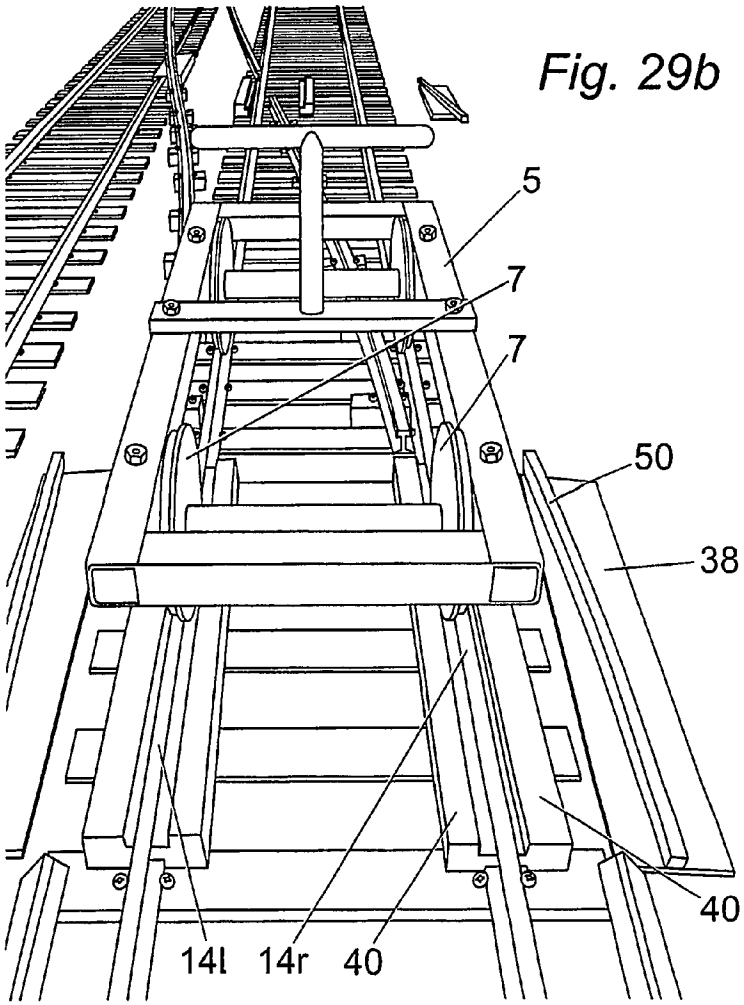
FIGS. 29*a, b, c, d* are end view photographs showing the train wheels passing a portion of the support members of FIG. 24*b* during normal running.
FIGS. 29*e* and 29*f* show the support members and gutt rails of FIG. 29*a* in position during normal running.
FIG. 29*g* is a perspective view showing the support members of FIG. 29*a* prior to installation.
Figure 29A:
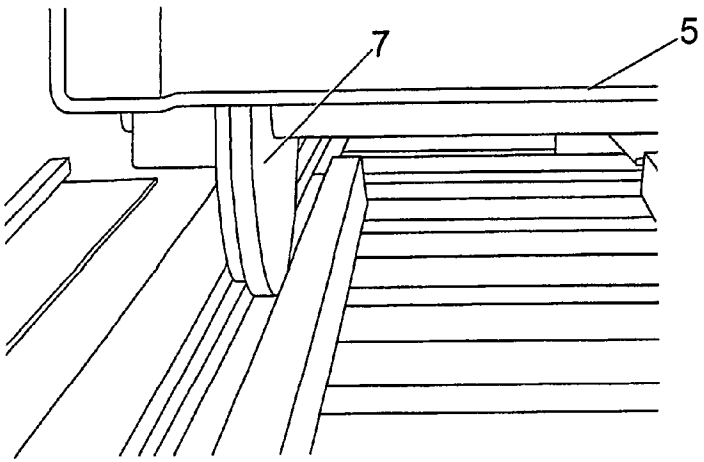
Figure 29D:
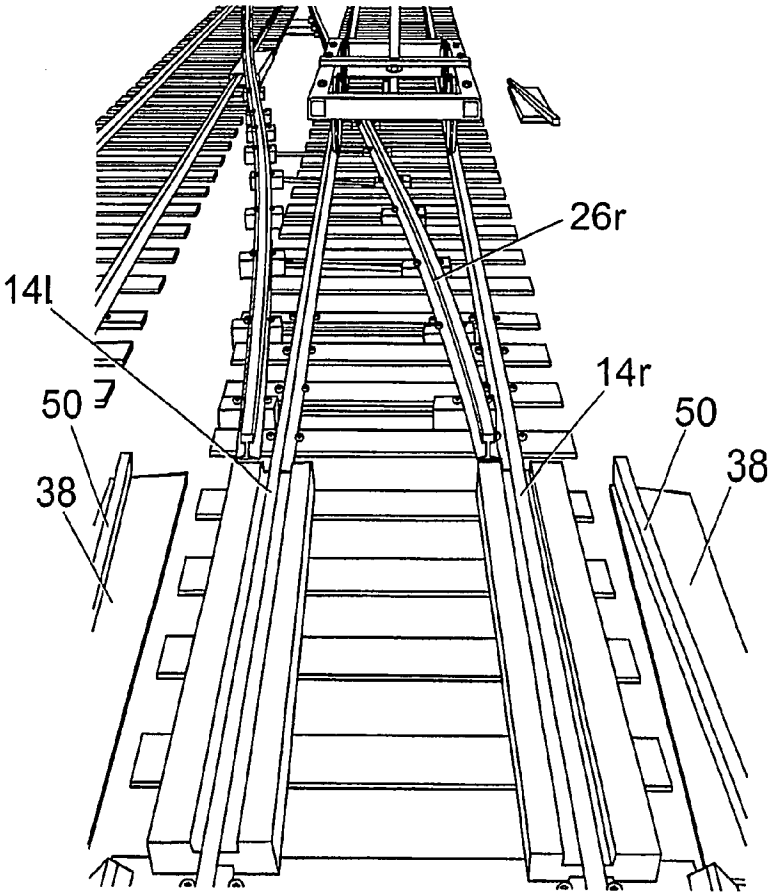
Figure 29C:
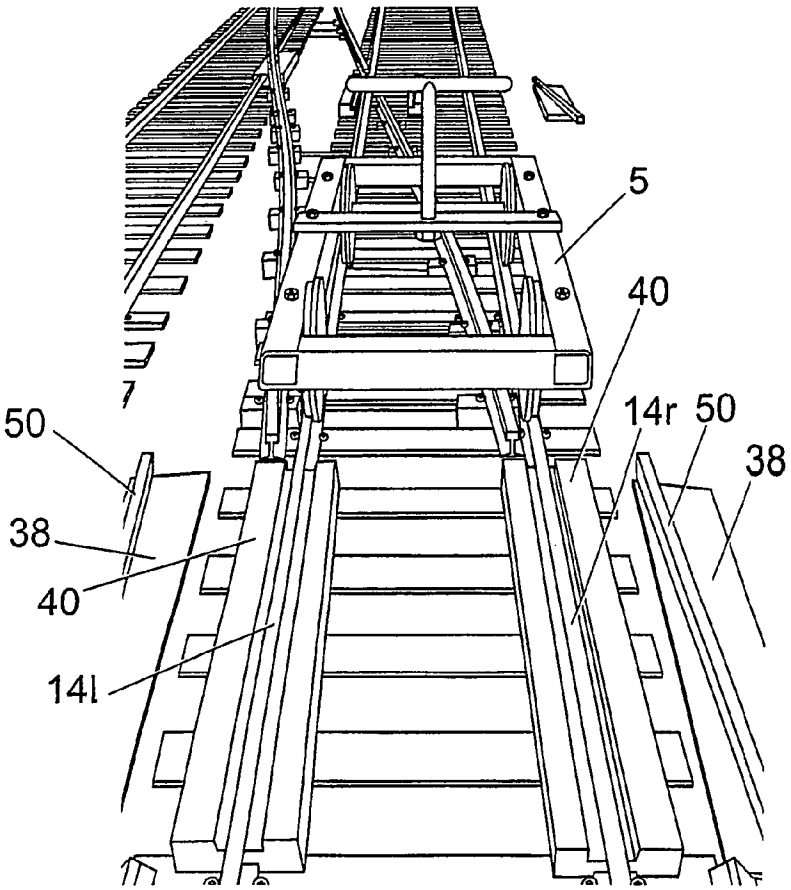
Figure 29F:
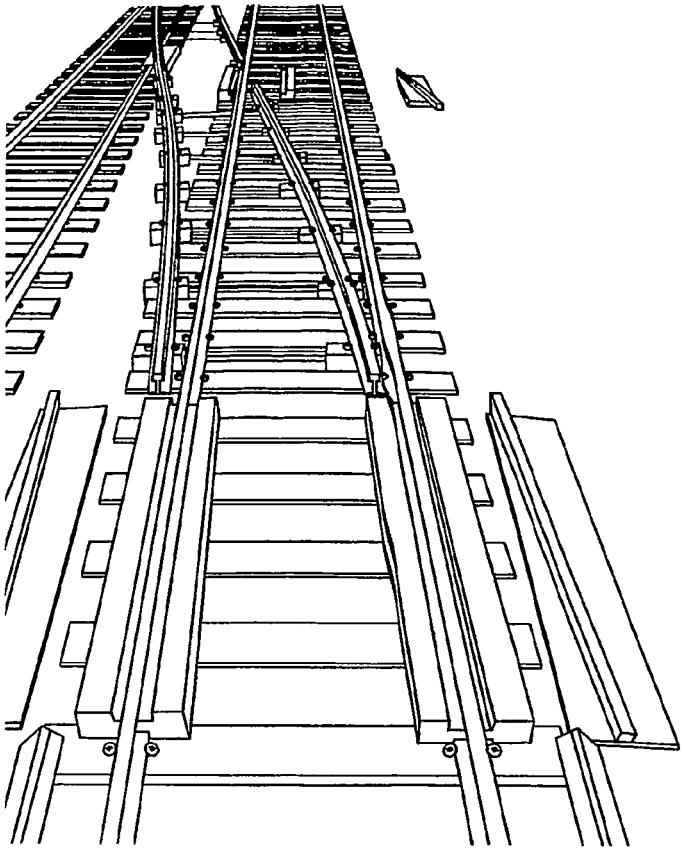
Figure 29E:
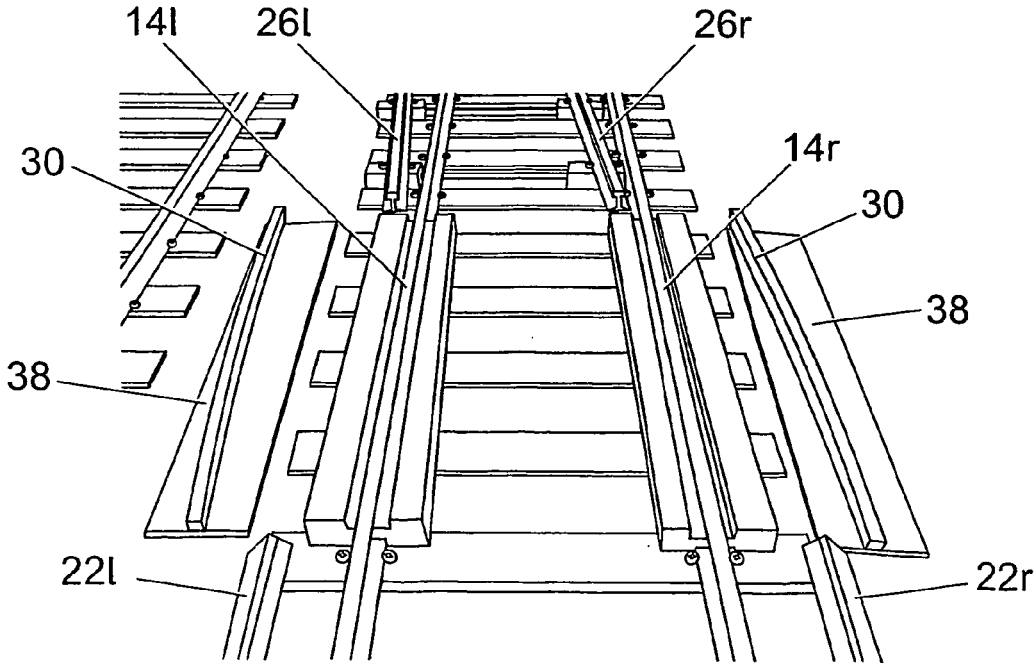
Figure 29G:
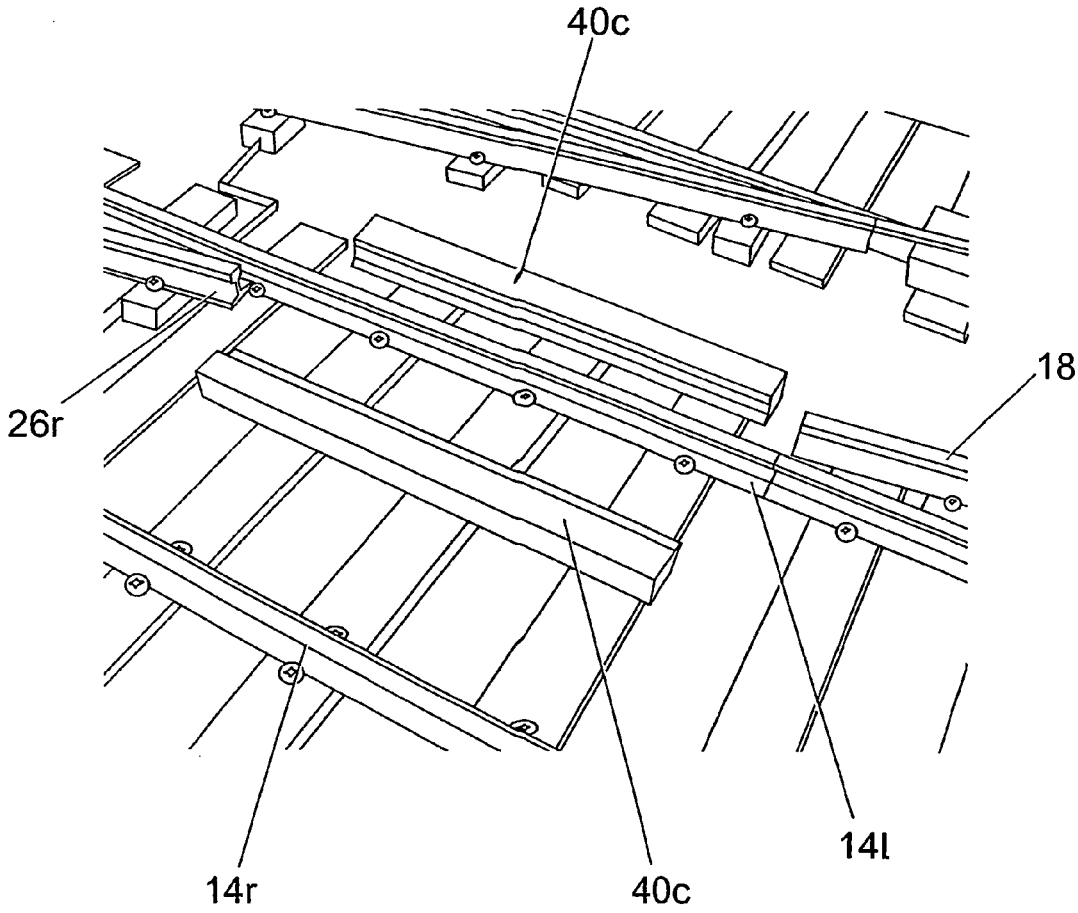

It will be appreciated by the reader that in this embodiment the supporting members 40 may be left in position during normal running of the railway track (as shown in FIGS. 29A, B, C, D, E and F); that is when no transfer of trains between one railway track and another is required, so that there is no crossover of a train 5 travelling on either north bound track 14 or south bound track 12. Alternatively the supporting members 40 may be placed to one side ready for installation as shown in FIG. 29G. Therefore in this embodiment of the invention the switch rail head 50 and planar member 38 may be installed and removed with relative ease and in a relatively short amount of time as desired.

Following on from the switch rail unit 100 the turnout next comprises a pair of gutt rails 25, 26. The gutt rails 25, 26 in this embodiment are broadly similar to that of the previous embodiment, and thus require no further description.

Figure 20A:
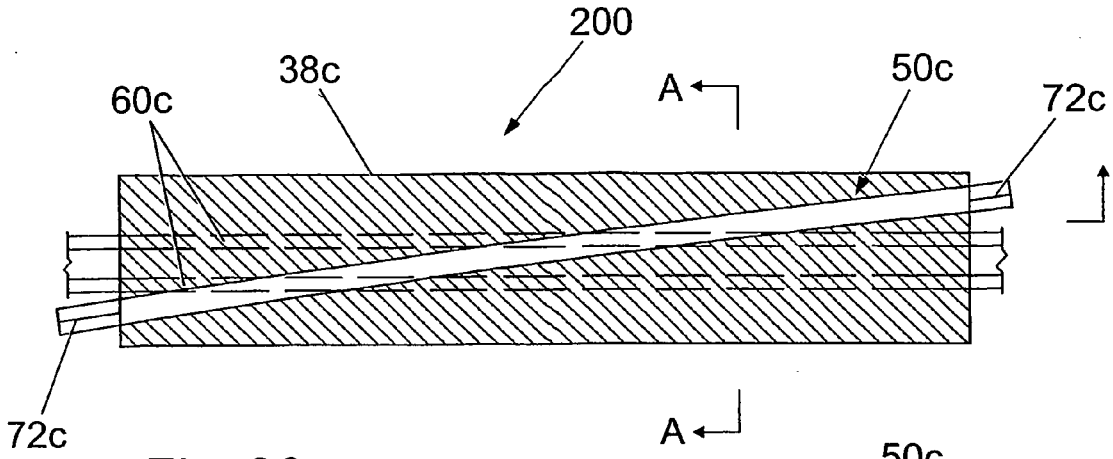
FIG. 20*a* is a plan view of an alternative embodiment of crossing rail to that shown in FIG. 1.
Figure 20C:
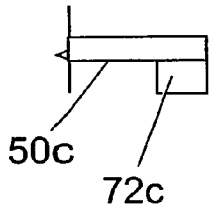
FIG. 20*c* is a side view of an end of the crossing rail of FIG. 20*a;*
Figure 20D:
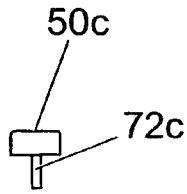
FIG. 20*d* is an end view of the end of the crossing rail of FIG. 20*c;*
Figure 20B:
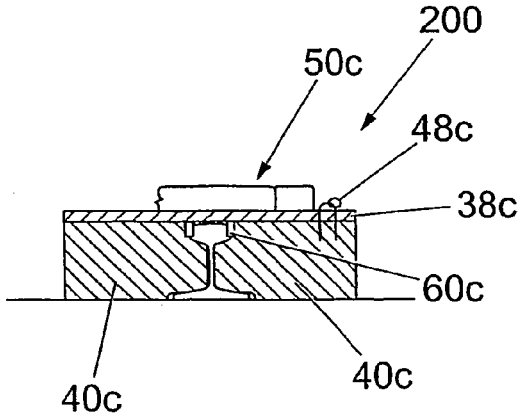
FIG. 20*b* is a cross-sectional view of the crossing rail of FIG. 20*a;*
Figure 30:
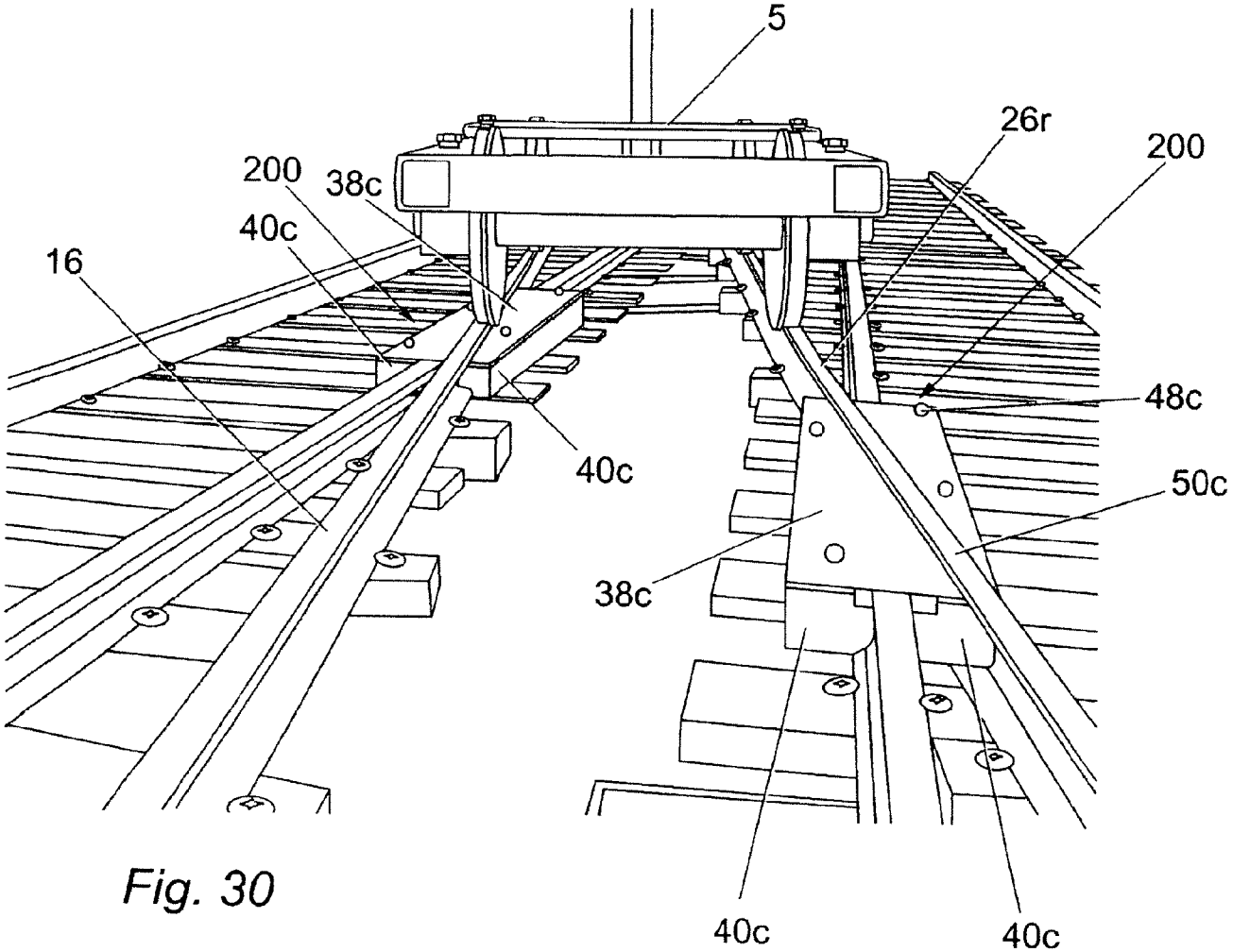
FIG. 30 is a perspective view showing the train passing over the crossing rails of FIG. 29*a*, whilst clearing the main tracks.
Figure 31A:
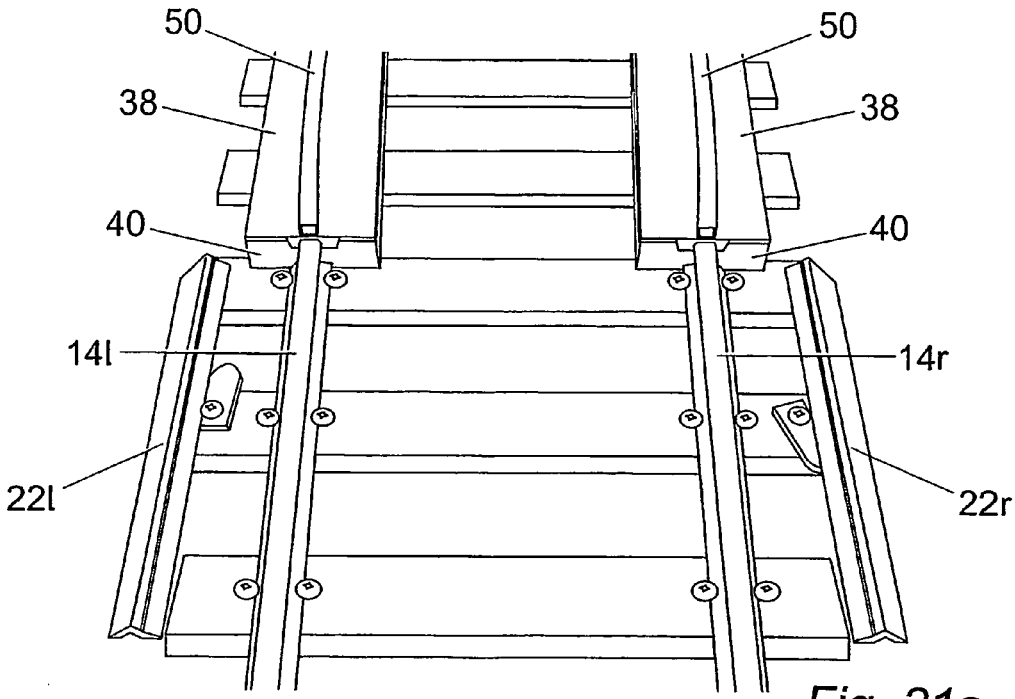
FIGS. 31*a* and 31*b* are perspective view photographs taken during installation of the ramp rails and switch rails of FIG. 29*a;*
Figure 31B:
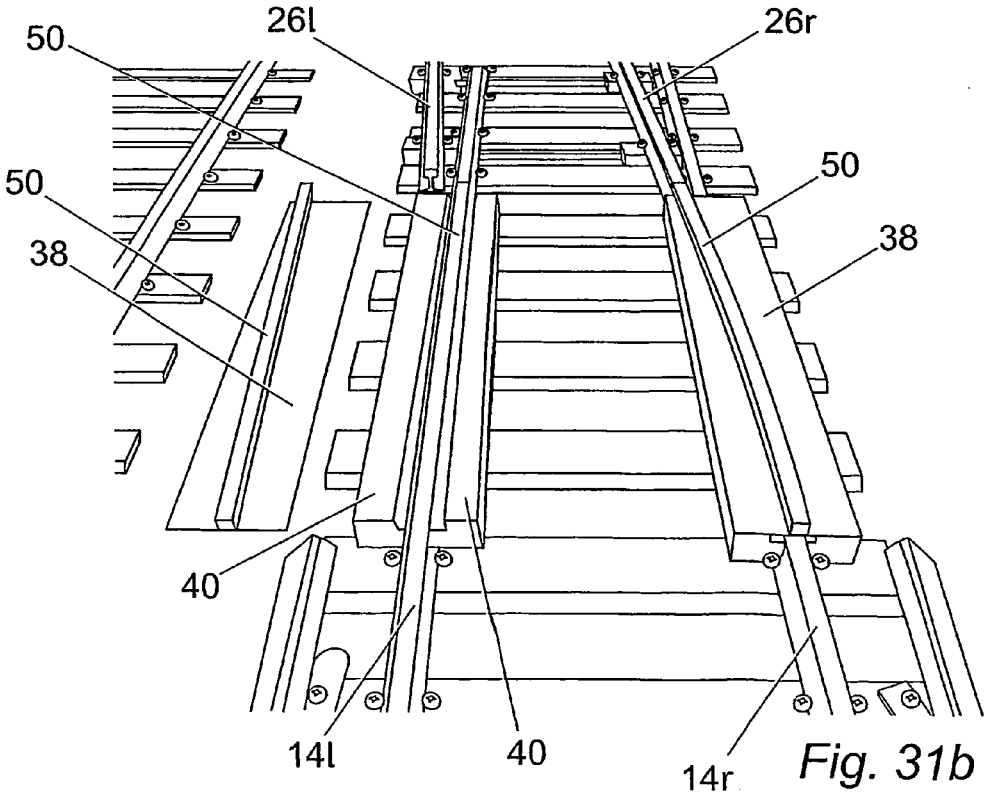

Following on from the gutt rails 25, 26, the turnout next comprises a pair of crossing units generally designated 200 (FIGS. 20A, B and FIG. 30). Each crossing unit 200 comprising a crossing rail head 50*c*, planar crossing member or plate 38*c*, guide flanges 60*c*, a pair of supporting members 40*c*, a pair of end plates 72*c*, and support connecting clip 48*c*.

The crossing rail head 50*c* has the same cross sectional shape as that of the switch rail 50, (i.e. upper portion of an I-shaped rail section), and extends diagonally between one end of the crossing unit 200 and the other, so as to point toward the south bound track 12 and thus away from the north bound track 14.

The crossing rail head 50*c* may span a longer distance along the crossing unit 200 than the crossing plate 38*c* and the supporting members 40*c*, thus creating an overhang at either or both ends of the crossing unit 200.

The crossing plate 38*c*, guide flanges 60*c*, supporting members 40*c*, and support connecting clips 48*c* are broadly similar to those of the switch rail unit 100, and thus require no further description.

The pair of end plates 72*c* protrude vertically downward from the overhang created by the crossing rail head 50*c*. Each end plate butts against the end of a supporting member 40*c*.

The end plates 72 of the switch rail head 50, and the end plates 72*c* of the crossing rail head 50*c* may be drilled to suit a standard connecting means such as a fishplate, in order to provide a secure connection between each rail head component.

The non-intrusive turnout 10 described in this embodiment has an advantage over the previous embodiment of additional support to the turnout track which is provided by the supporting members 40, 40*c* whilst still allowing the switch rail head 50, crossing rail 50*c*, plate 38, and crossing plate 38*c* to be removed and installed relatively easily, without permanent alteration (i.e. cutting) of the existing track.

Figure 21C:
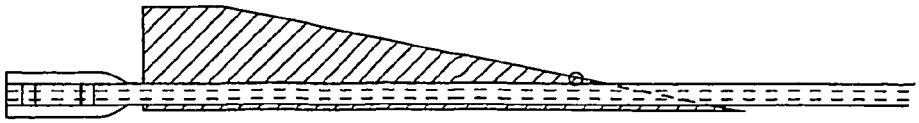
FIG. 21*c* is a plan view of the crossing rail of FIG. 21*a* without the existing rail for clarity.
Figure 21D:
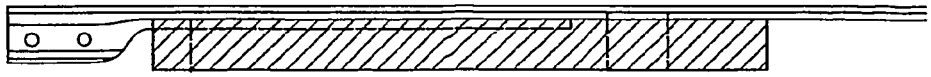
FIG. 21*d* is a side view of the crossing rail of FIG. 21*c;*
Figure 21A:
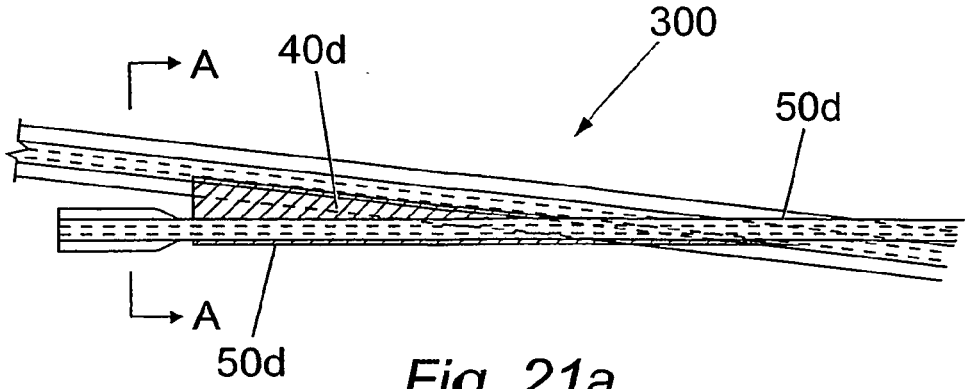
FIG. 21*a* is a plan view of the crossing rail of FIG. 20*a* as it crosses an existing rail of a railway track.
Figure 21B:
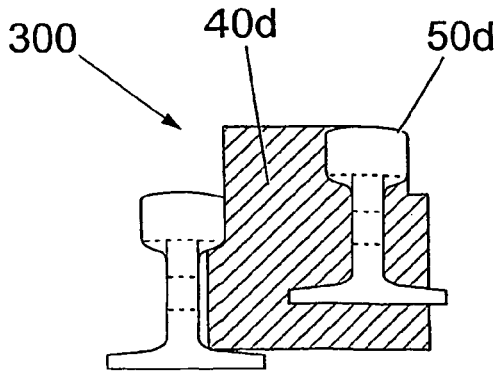
FIG. 21*b* is a cross-sectional view of the crossing rail taken through the line A-A of FIG. 21*a;*
Figure 22A:
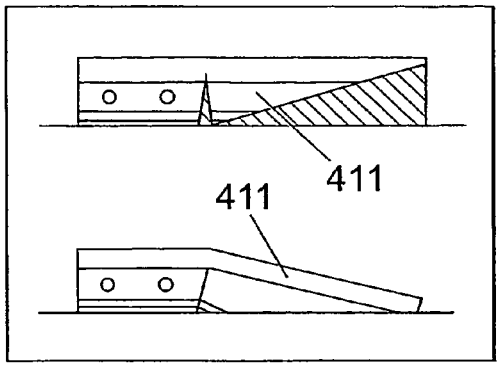
FIGS. 22*a, b, c*, and *d* are side views of possible/optional gutt rail deflecting means for use with a gutt rail of the turnout of FIG. 1.
Figure 22B:
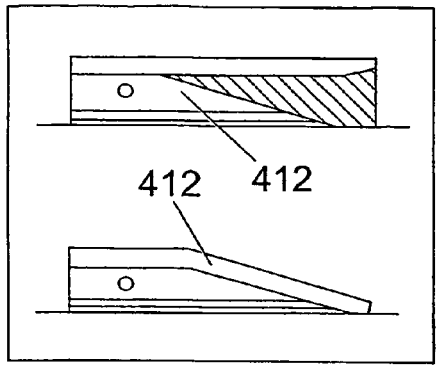
Figure 22C:
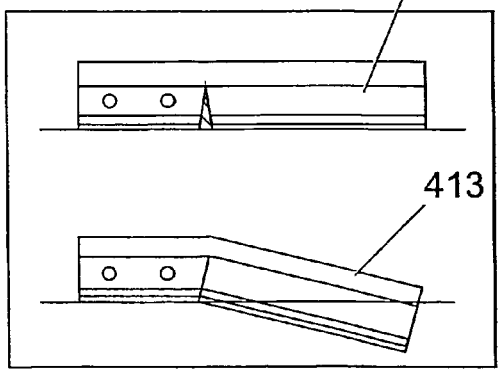
Figure 22D:
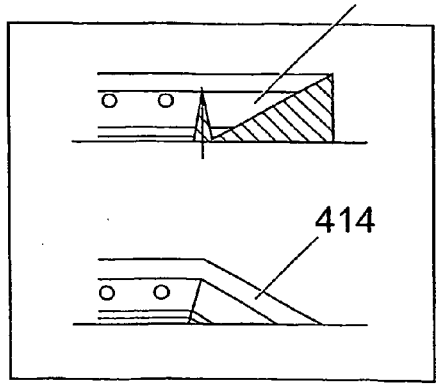

FIGS. 21A and B show the crossing unit of a non-intrusive turnout in accordance with a further alternative embodiment of the present invention, which will now be described.

A partially supported crossing unit generally designated 300 comprises a crossing rail head 50*d*, and a tapered supporting member 40*d*.

The crossing rail head 50*d* is broadly similar to that of the previous embodiments e.g. 50*c* and thus requires no further description.

The tapered supporting member 40*d* is wedge shaped such that it fits in the gap created between the crossing rail 50*d* and the existing rail near the point of crossing over.

For each of the previously described embodiments, when the ramp rails 21, 22, switch rails 23, 24, and crossing rails 29, 30 are removed it is preferable that the end of each gutt rail 25, 26 exposed to an oncoming train is provided with deflecting means which deflect any loose items (not shown) suspended below the railway carriage (not shown) away from the gutt rails 25, 26, thereby preventing such items from snagging on the gutt rails 25, 26 which could otherwise result in derailment of the railway carriage. FIGS. 21A, B, C and D show possible deflecting means for this purpose. Each deflecting means is adapted to be easily fitted onto the exposed end of the gutt rails 25, 26 by suitable means, for example a fishplate. Prior to re-installation of the ramp rails 21, 22, switch rails 23, 24, and crossing rails 29, 30, the deflecting means will be removed.

Figure 23A:
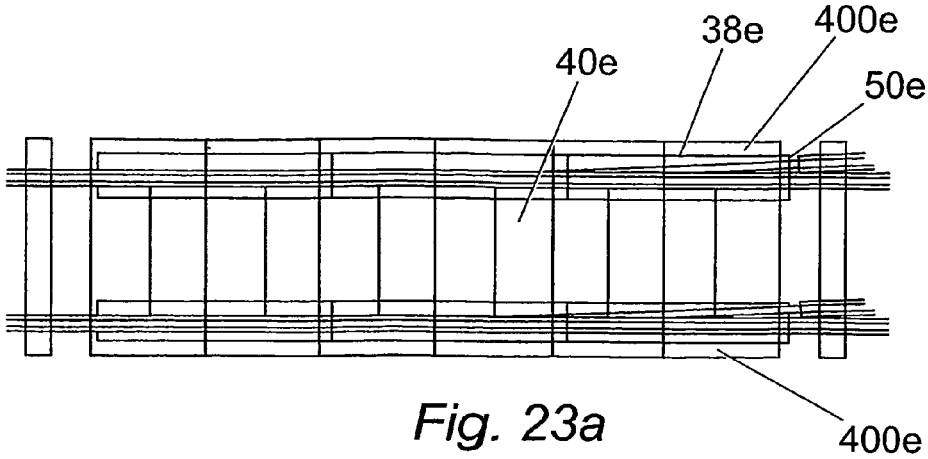
FIG. 23*a* is a plan view of level crossing support members for supporting the switch rail of FIG. 19*a;*
Figure 23:
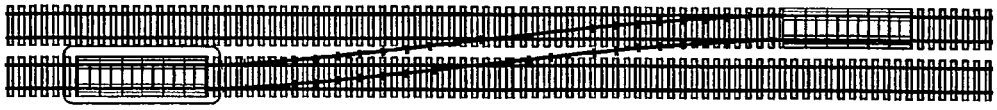
FIG. 23 is a plan overview showing the position of the level crossing support members of FIG. 23*a* within the crossover.
Figure 23B:
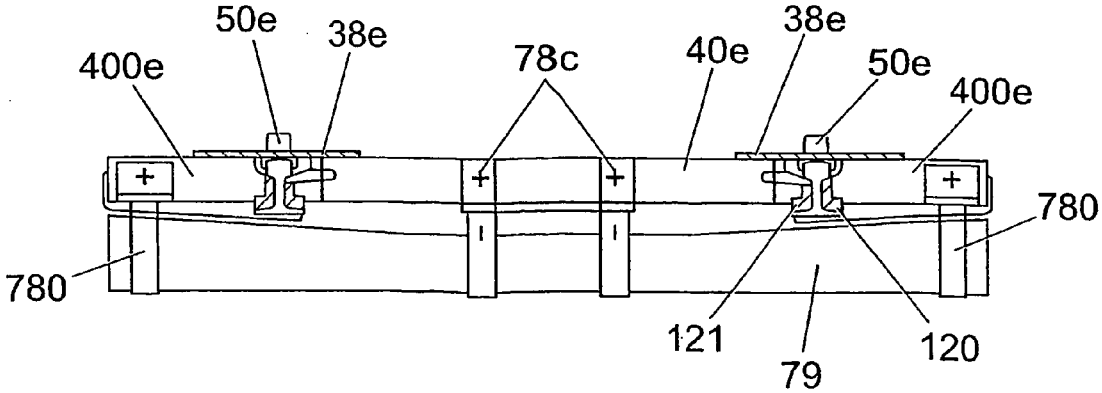
FIG. 23*b* is a cross-sectional view of level crossing support members of FIG. 23*a;*

FIGS. 23, 23A and 23B show supporting means for a switch rail and crossing unit of a non-intrusive turnout in accordance with a further alternative embodiment of the present invention, which will now be described.

Central level crossing support members 40*e* known and used in the industry are wedged between the existing rails and are supported by central supports 78*c* which are connected to the existing sleeper 79. The central level crossing support members 40*e* are complimented by outer level crossing support members 400*e* which are supported by outer supports 78*o*. Positioned between the outer level crossing support members 400*e* and the inner level crossing support members 40*e* are outer packing wedges 120 and inner packing wedges 121. The outer and inner packing members 120, 121 secure the level crossing members 40*e*, 400*e* in both the lateral and vertical directions.

The switch rail head 50*e* and planar member 38*e* are broadly similar to that described previously (FIG. 19) and are situated above the level crossing support members 40*e* and 400*e*.

Figure 23C:
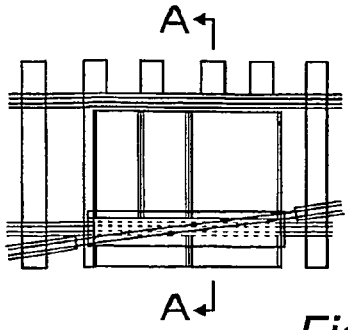
FIG. 23*c* is a detailed plan view of level crossing support members which is an alternative embodiment for supporting the crossing rails of the turnout of FIG. 1.
Figure 23E:
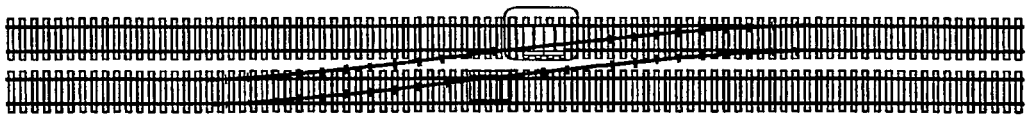
FIG. 23*e* is an plan overview showing the position of the level crossing support members of FIG. 23*c* within the crossover.
Figure 23D:
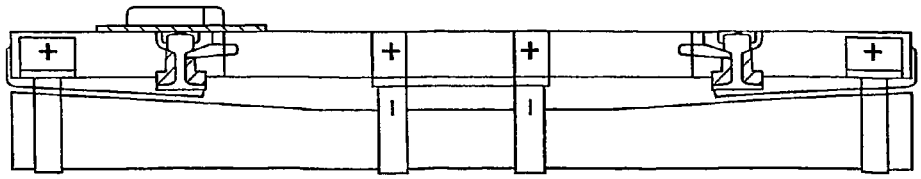
FIG. 23*d* is a cross-sectional view of the level crossing support members and the crossing rail of FIG. 23*c;*

A similar adaptation is shown in FIGS. 23C and D making use of the level crossing supports 40*e* and 400*e* in the crossing rail unit.

This support arrangement has the advantage over previous embodiments of the invention in that it allows the loads exerted by the passing train to be transferred directly to the sleeper and existing rail, whilst using currently available components.

It should be noted that embodiments of the present invention offer a number of advantages over previous apparatus for transferring trains from one track to another, namely but not exclusively that, the crossover is non-intrusive, there is no requirement for the train wheel to run on the flange at any point, and that the embodiments do not require a pivotable section to effect the transfer, thereby decreasing the likelihood of malfunction of the apparatus, and that the simultaneous incline of the ramps avoids twisting occurring to the train axles/bogeys as they run up the ramps.

Modifications and improvements may be made to the embodiments described herein without departing from the scope of the invention. For instance, the height of approximately 50 mm of the various components of the non-intrusive temporary turnout 10 can be varied to suit the flanges provided on the wheels of trains in different countries and may be adapted to accommodate various track gauges. Those skilled in the art will realise that the height of the various components simply needs to be equal to, or more preferably just slightly higher than the extent of the flange provided on the wheels of trains in each particular country.

The invention claimed is:

1. A turnout apparatus for a railway track, the turnout apparatus comprising a raised track surface which is adapted to provide a path along which wheels of a train can travel from one railway track to another, wherein the raised track surface is of a sufficient height such that the wheels of the train are arranged to clear the railway tracks, wherein at least a portion of each rail of the raised track surface comprises a rail head portion arranged to lie over or around a supporting member, the supporting member comprising a longitudinal axis which is arranged parallel to a longitudinal axis of a rail of the railway track and is arranged to lie over or around the rail of the railway track being crossed, wherein the supporting member comprises at least an upper supporting member and at least a lower supporting member, the upper supporting member being planar and having an upper surface and a lower surface, the upper surface attached to at least a portion of a lower surface of the raised track surface and the lower surface laying on top of an uppermost surface of the lower supporting member, and wherein a pair of lower supporting members are provided at either side of at least a portion of the rail of the railway track being crossed, the pair of lower supporting members combining to provide a substantially similar shape, width and position along the rail of the railway track being crossed as the upper supporting member, and are adapted to be releasably engaged to the upper supporting member and releasably fixed to the upper supporting member.

2. The apparatus according to claim 1, wherein a crossover comprising a pair of turnouts is provided, the crossover being non-intrusive and optionally temporary.

3. The apparatus according to claim 1, wherein the raised track surface comprises a pair of rails, each rail further comprising a ramp surface which comprises a linear taper from a short or no height end to a relatively tall height end, the relatively tall height end being of the same height as that of the raised track surface and adjacent to an end of the raised track surface, the two combining to provide a path along which the wheel is permitted to travel while maintaining a substantially equal distance between a pair of raised rails, which combined, form the raised track surface.

4. The apparatus according to claim 3, wherein the ramp surface comprises a ramp for each rail, where both ramps incline simultaneously, avoiding differential levels, in relation to the respective rails of the railway tracks.

5. The apparatus according to claim 1, wherein the planar upper supporting member is substantially wider than the rail of the railway track being crossed and comprises a rectangular plate member.

6. The apparatus according to claim 1 wherein a pair of guides are provided along at least a portion of a length of the upper supporting member, the guides running parallel to the upper supporting member's longitudinal axis, and projecting downwardly in order, in use, to straddle the rail of railway track being crossed.

7. The apparatus according to claim 1, wherein the raised track surface comprises a plurality of rail members, one or more of which comprise a curved radius away from one of the railway tracks towards the other railway track, the plurality of rail members combining to form a turnout having a substantially continuous rail surface and comprising:

a ramp member adapted to raise the train wheel to the raised height;

a curved radius rail adapted to urge the train away from one of the railway tracks towards the other railway track;

a substantially straight rail adapted to transfer the train from the curved radius rail of one track toward the other track; and a crossover rail adapted to allow the train to pass over the inner rails of the first and second existing railway tracks at the raised height.

8. The apparatus according to claim 2, wherein, one or more sections of the crossover are removed from engagement with one of the first and second existing railway track(s), such that the train does not travel onto the other of the first and second existing railway tracks and a second portion of the raised track surface and at least a lower supporting member are left in place to allow normal running of a train along one of a first and second existing railway track(s) having a crossover installed.

* * * * *

UNITED STATES PATENT AND TRADEMARK OFFICE

CERTIFICATE OF CORRECTION

PATENT NO. : 7,604,205 B2
APPLICATION NO. : 10/524727
DATED : October 20, 2009
INVENTOR(S) : Donald McCallum It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 897 days.

Signed and Sealed this

Fifth Day of October, 2010

David J. Kappos

David J. Kappos
*Director of the United States Patent and Trademark Office*